US011883713B2

(12) United States Patent
Whalen et al.

(10) Patent No.: US 11,883,713 B2
(45) Date of Patent: Jan. 30, 2024

(54) DAP SYSTEM CONTROL AND RELATED DEVICES AND METHODS

(71) Applicants: Boost Treadmills, LLC, Palo Alto, CA (US); Robert Tremaine Whalen, Los Altos, CA (US)

(72) Inventors: Sean Tremaine Whalen, Mountain View, CA (US); Thomas Jack Waldo Allen, Palo Alto, CA (US); Robert Tremaine Whalen, Los Altos, CA (US); Gunnar Manglus, Uniküla (EE); Kristjan Tiimus, Tabasalu (EE); Mikk Murumae, Tallinn (EE)

(73) Assignee: Boost Treadmills, LLC, Palo Alto, CA (US)

( * ) Notice: Subject to any disclaimer, the term of this patent is extended or adjusted under 35 U.S.C. 154(b) by 0 days.

(21) Appl. No.: 17/964,851

(22) Filed: Oct. 12, 2022

(65) Prior Publication Data

US 2023/0115258 A1 Apr. 13, 2023

Related U.S. Application Data

(60) Provisional application No. 63/255,001, filed on Oct. 12, 2021, provisional application No. 63/254,969, (Continued)

(51) Int. Cl.

| | |
|---|---|
| ***A63B 21/00*** | (2006.01) |
| ***A63B 22/02*** | (2006.01) |
| ***A63B 22/00*** | (2006.01) |

(52) U.S. Cl.

CPC .... *A63B 22/0046* (2013.01); *A63B 21/00181* (2013.01); *A63B 22/02* (2013.01); (Continued)

(58) Field of Classification Search

CPC ..... A63B 21/00181; A63B 22/02; A63B 2208/053; A63B 2225/093; A63B 2225/62

See application file for complete search history.

(56) References Cited

U.S. PATENT DOCUMENTS 44,198 A 9/1864 Jones
54,530 A 5/1866 Hadfield
(Continued)

FOREIGN PATENT DOCUMENTS

CN 2034152 U 3/1989
CN 2208414 Y 9/1995
(Continued)

OTHER PUBLICATIONS

Showa Denki Taiwan, "てらす·ウォーカー, 取扱説明書・注意書" ("Terasu Walker, Instruction Manual"), May 14, 2015, Taiwan.
(Continued)

*Primary Examiner* — Joshua Lee
(74) *Attorney, Agent, or Firm* — KandareIP, LLC; Anthony Kandare

(57) ABSTRACT

A method for controlling a DAP system is provided that includes calculating a user seal interface height based on an estimated user height, and based thereon determining an attachment carriage height and a usage carriage height different than the user seal interface height. The method also includes driving powered vertical lifts to raise each carriage to an attachment position at the attachment carriage height while the user is in the DAP system through the top opening including raising about the user the seal frame attached to the carriages and thereby raising the top opening attached to the seal frame, and also controlling the lifts to retain the attachment position during user seal attachment and confirming the attachment. Responsive to confirming, the method includes driving the lifts to move each carriage to a
(Continued)

usage position at the usage carriage height and inflating the enclosure to an unweighting.

20 Claims, 20 Drawing Sheets

Related U.S. Application Data filed on Oct. 12, 2021, provisional application No. 63/254,972, filed on Oct. 12, 2021.

(52) U.S. Cl.
CPC ... *A63B 2208/053* (2013.01); *A63B 2225/093* (2013.01); *A63B 2225/62* (2013.01)

(56) References Cited

U.S. PATENT DOCUMENTS 72,631 A 12/1867 Hadfield
100,867 A 3/1870 Curran
871,074 A 11/1907 Stockton
1,152,014 A 8/1915 Farkell
1,182,018 A 5/1916 Koenig
1,336,774 A 4/1920 Cooper
1,504,166 A 8/1924 Thornley
2,262,019 A 11/1941 Lincoln
2,785,004 A 3/1957 Cooper
3,165,314 A 1/1965 Clearman
3,176,793 A 4/1965 Hlacia
3,192,014 A 6/1965 Leyshon
3,332,176 A 7/1967 Knetzer
3,428,015 A 2/1969 Cloud
3,768,467 A 10/1973 Jennings
3,911,913 A 10/1975 June
4,149,712 A 4/1979 Murphy
4,257,407 A 3/1981 Macchi
4,343,302 A 8/1982 Dillon
4,411,422 A 10/1983 Solloway
4,509,513 A 4/1985 Lasley
4,536,163 A 8/1985 Schnirch et al.
4,576,376 A 3/1986 Miller
4,614,337 A 9/1986 Schonenberger
4,621,621 A 11/1986 Marsalis
4,712,788 A 12/1987 Gaudreau, Jr.
4,731,882 A 3/1988 Ekman
4,776,581 A 10/1988 Shepherdson
4,805,601 A 2/1989 Eischen, Sr.
4,887,317 A 12/1989 Phillips, Sr. et al.
4,934,694 A 6/1990 McIntosh
4,959,047 A 9/1990 Tripp, Jr.
4,974,829 A 12/1990 Gamow et al.
5,029,579 A 7/1991 Trammell
5,075,902 A 12/1991 McReynolds et al.
5,109,837 A 5/1992 Gamow
5,129,647 A 7/1992 Castellanos
5,133,339 A 7/1992 Whalen et al.
5,221,241 A 6/1993 Bare, II
5,242,339 A 9/1993 Thornton
5,356,361 A 10/1994 Watenpaugh
5,360,001 A 11/1994 Brill et al.
5,368,532 A 11/1994 Farnet
5,470,293 A 11/1995 Schonenberger
5,527,242 A 6/1996 Gangloff
5,571,062 A 11/1996 Saganovsky
5,577,598 A 11/1996 Schoenenberger
5,582,561 A 12/1996 Gonzalez
5,623,944 A 4/1997 Nashner
5,662,311 A 9/1997 Waedekin et al.
5,678,543 A 10/1997 Bower
5,700,232 A 12/1997 Clausen et al.
5,702,323 A 12/1997 Poulton
5,704,881 A 1/1998 Dudley
5,706,822 A 1/1998 Khavari
5,738,612 A 4/1998 Tsuda
5,799,652 A 9/1998 Kotliar
5,830,162 A 11/1998 Giovannetti
5,919,419 A 7/1999 Majuri
5,921,892 A 7/1999 Easton
5,960,480 A 10/1999 Neustater et al.
6,027,464 A 2/2000 Dahlquist
6,033,344 A 3/2000 Trulaske et al.
6,042,537 A 3/2000 Kaiser
6,146,315 A 11/2000 Schonenberger
6,220,992 B1 4/2001 Shafik
6,273,844 B1 8/2001 Kelsey et al.
6,332,290 B1 12/2001 Delamare
6,332,354 B1 12/2001 Lalor et al.
6,348,025 B1 2/2002 Schonenberger
6,405,685 B1 6/2002 Cox
6,482,128 B1 11/2002 Michalow
6,527,678 B1 3/2003 Wang et al.
6,539,946 B2 4/2003 Weyergans
6,554,747 B1 4/2003 Rempe
6,565,624 B2 5/2003 Kutt et al.
6,609,054 B2 8/2003 Wallace
6,645,126 B1 11/2003 Martin et al.
6,656,091 B1 12/2003 Abelbeck et al.
6,666,831 B1 12/2003 Edgerton et al.
D495,384 S 8/2004 Rolfes
6,783,482 B2 8/2004 Oglesby et al.
D497,961 S 11/2004 Rolfes
6,821,233 B1 11/2004 Colombo et al.
6,905,459 B2 6/2005 Humphries, Jr.
6,918,858 B2 7/2005 Watterson et al.
7,063,678 B1 6/2006 Cook
7,141,007 B2 11/2006 Egger
7,166,064 B2 1/2007 Watterson et al.
7,494,450 B2 2/2009 Solomon
7,556,040 B2 7/2009 Meyer et al.
7,591,795 B2 * 9/2009 Whalen ..... A63B 22/02 600/19
7,594,281 B1 9/2009 Stinson et al.
7,645,212 B2 1/2010 Ashby et al.
7,762,930 B2 7/2010 Egger
7,780,587 B2 8/2010 Thornton et al.
7,785,242 B2 8/2010 Solomon
7,805,186 B2 9/2010 Pulkkinen et al.
7,837,597 B2 11/2010 Reyes et al.
7,850,629 B2 12/2010 Ravikumar
7,857,731 B2 12/2010 Hickman et al.
7,862,478 B2 1/2011 Watterson et al.
7,914,420 B2 3/2011 Daly et al.
8,235,724 B2 8/2012 Gilley et al.
8,308,618 B2 11/2012 Bayerlein et al.
8,447,401 B2 5/2013 Miesel et al.
8,464,716 B2 * 6/2013 Kuehne ..... A63B 22/02 601/19
8,480,602 B1 7/2013 Cook
D695,856 S 12/2013 Jacobs et al.
8,639,455 B2 1/2014 Horst et al.
8,679,040 B2 3/2014 Horst
8,840,572 B2 * 9/2014 Whalen ..... A61G 10/023 601/6
8,900,074 B1 12/2014 Johnson et al.
8,900,098 B2 * 12/2014 Egan ..... A63B 24/0087 482/4
8,968,163 B1 3/2015 Vidmar
9,272,175 B2 * 3/2016 Egan ..... A63B 21/00181
9,454,541 B2 9/2016 Chou
9,554,964 B1 1/2017 Johnson et al.
9,561,149 B2 2/2017 Johnson et al.
9,642,764 B2 * 5/2017 Kuehne ..... A61H 1/00
9,914,003 B2 3/2018 Kuehne et al.
10,004,656 B2 * 6/2018 Whalen ..... A63B 21/00181
10,111,589 B2 10/2018 Kirby et al.
10,130,554 B2 11/2018 Aronson
10,132,011 B2 11/2018 Malina et al.
10,154,789 B2 12/2018 Raghuram et al.
10,179,078 B2 1/2019 Bhugra et al.
10,219,734 B2 * 3/2019 Williams ..... A61G 10/02
10,265,565 B2 4/2019 Jue et al.
10,265,566 B2 4/2019 Bayerlein et al.
10,342,461 B2 7/2019 Basta et al.

(56) References Cited

U.S. PATENT DOCUMENTS

| | | | | |
|---|---|---|---|---|
| 10,366,628 | B2 | 7/2019 | White et al. | |
| 10,398,619 | B2 | 9/2019 | Crombie et al. | |
| 10,427,293 | B2 | 10/2019 | Asbeck et al. | |
| 10,493,309 | B2 | 12/2019 | Jue et al. | |
| 10,533,913 | B2 | 1/2020 | Lee et al. | |
| 10,596,365 | B2 | 3/2020 | Hyde et al. | |
| 10,674,958 | B2 | 6/2020 | Bleich et al. | |
| 10,709,926 | B2 | 7/2020 | Bayerlein et al. | |
| 10,709,935 | B2 | 7/2020 | Anderson | |
| 10,773,121 | B2 | 9/2020 | Del Monaco et al. | |
| 10,816,177 | B1 | 10/2020 | Bayerlein et al. | |
| 10,843,036 | B2 * | 11/2020 | Bayerlein | A63B 22/025 |
| 10,905,914 | B2 | 2/2021 | Bayerlein et al. | |
| 10,918,926 | B2 | 2/2021 | Pennington | |
| 11,134,890 | B2 | 10/2021 | Kirby et al. | |
| 11,311,732 | B2 | 4/2022 | Bleich et al. | |
| 11,517,781 | B1 * | 12/2022 | Whalen | A61G 10/023 |
| 11,559,720 | B2 * | 1/2023 | Bayerlein | A63B 22/025 |
| 2001/0018564 | A1 | 8/2001 | Manor et al. | |
| 2002/0010056 | A1 | 1/2002 | Borsheim | |
| 2002/0025889 | A1 * | 2/2002 | Egger | A63B 22/0605 482/57 |
| 2002/0032103 | A1 | 3/2002 | Cook | |
| 2003/0032904 | A1 | 2/2003 | Egger | |
| 2003/0149615 | A1 | 8/2003 | Orban | |
| 2003/0204148 | A1 | 10/2003 | Lange et al. | |
| 2004/0019304 | A1 | 1/2004 | West | |
| 2004/0171465 | A1 | 9/2004 | Hald et al. | |
| 2004/0238285 | A1 | 12/2004 | Stokes | |
| 2005/0075680 | A1 | 4/2005 | Lowry et al. | |
| 2005/0164839 | A1 | 7/2005 | Watterson et al. | |
| 2006/0009333 | A1 | 1/2006 | Wang | |
| 2006/0185065 | A1 | 8/2006 | Allen | |
| 2006/0190051 | A1 | 8/2006 | Gerber et al. | |
| 2006/0199712 | A1 | 9/2006 | Barnard et al. | |
| 2007/0016116 | A1 | 1/2007 | Reinkensmeyer et al. | |
| 2007/0054783 | A1 * | 3/2007 | Egger | A63B 24/00 601/1 |
| 2007/0219059 | A1 | 9/2007 | Schwartz et al. | |
| 2007/0272484 | A1 | 11/2007 | Helms | |
| 2008/0246581 | A1 | 10/2008 | Irie et al. | |
| 2008/0281633 | A1 | 11/2008 | Burdea et al. | |
| 2008/0306412 | A1 | 12/2008 | Nieminen et al. | |
| 2009/0014004 | A1 | 1/2009 | Whalen et al. | |
| 2009/0036272 | A1 | 2/2009 | Yoo | |
| 2009/0047644 | A1 | 2/2009 | Mensah et al. | |
| 2009/0221404 | A1 | 9/2009 | Dorogusker et al. | |
| 2009/0236176 | A1 | 9/2009 | Sheu | |
| 2009/0255531 | A1 | 10/2009 | Johnson et al. | |
| 2009/0269728 | A1 | 10/2009 | Verstegen et al. | |
| 2011/0098157 | A1 | 4/2011 | Whalen et al. | |
| 2012/0238921 | A1 * | 9/2012 | Kuehne | A63B 71/0009 601/5 |
| 2013/0095459 | A1 | 4/2013 | Tran | |
| 2014/0194252 | A1 * | 7/2014 | Arimoto | A63B 23/04 482/51 |
| 2014/0296037 | A1 | 10/2014 | Razzaq | |
| 2015/0379239 | A1 | 12/2015 | Basta et al. | |
| 2016/0000155 | A1 | 1/2016 | Marecek et al. | |
| 2016/0001118 | A1 | 1/2016 | Kuehne et al. | |
| 2016/0001119 | A1 | 1/2016 | Jue et al. | |
| 2016/0007885 | A1 | 1/2016 | Basta et al. | |
| 2016/0008650 | A1 | 1/2016 | Jue et al. | |
| 2016/0073704 | A1 | 3/2016 | Basta et al. | |
| 2016/0250519 | A1 | 9/2016 | Watterson | |
| 2017/0128769 | A1 * | 5/2017 | Long | A63B 71/0686 |
| 2017/0367916 | A1 * | 12/2017 | Kuehne | A63B 21/00181 |
| 2019/0150530 | A1 | 5/2019 | Basta et al. | |
| 2019/0392939 | A1 * | 12/2019 | Basta | G16H 20/30 |
| 2020/0016025 | A1 | 1/2020 | Devanaboyina | |
| 2020/0108291 | A1 | 4/2020 | Piazza et al. | |
| 2020/0221975 | A1 * | 7/2020 | Basta | A63B 71/0622 |
| 2020/0384309 | A1 | 12/2020 | Long et al. | |
| 2021/0187348 | A1 * | 6/2021 | Phillips | A63B 22/025 |
| 2021/0299520 | A1 | 9/2021 | Evancha et al. | |

FOREIGN PATENT DOCUMENTS

| | | | |
|---|---|---|---|
| CN | 2920312 | Y | 7/2007 |
| CN | 103638633 | B | 3/2014 |
| CN | 203647961 | U | 6/2014 |
| CN | 203663349 | U | 6/2014 |
| CN | 203915904 | U | 11/2014 |
| CN | 104759060 | B | 7/2015 |
| CN | 104800047 | A | 7/2015 |
| CN | 105380657 | B | 3/2016 |
| CN | 105380658 | B | 3/2016 |
| CN | 105579014 | B | 5/2016 |
| CN | 107158648 | A | 9/2017 |
| CN | 207838129 | U | 9/2018 |
| CN | 208115027 | U | 11/2018 |
| CN | 208541744 | U | 2/2019 |
| CN | 208893547 | U | 5/2019 |
| CN | 209845965 | U | 12/2019 |
| CN | 111135537 | A | 5/2020 |
| DE | 20305670 | U1 | 8/2003 |
| DE | 10362043 | A1 | 5/2005 |
| DE | 102006010887 | A1 | 9/2007 |
| JP | 59002993 | A | 1/1984 |
| JP | S63109878 | A | 5/1988 |
| JP | H05500760 | A | 2/1993 |
| JP | H0549596 | A | 3/1993 |
| JP | H1022334 | A | 1/1998 |
| JP | 11113988 | A | 4/1999 |
| JP | 2000342713 | A | 12/2000 |
| JP | 2001112886 | A | 4/2001 |
| JP | 2001517187 | A | 10/2001 |
| JP | 2002028202 | A | 1/2002 |
| JP | 2002360644 | A | 12/2002 |
| JP | 2004073445 | A | 3/2004 |
| JP | 2005102798 | A | 4/2005 |
| JP | 2007151676 | A | 6/2007 |
| WO | 2006050787 | A1 | 5/2006 |

OTHER PUBLICATIONS

Showa Denki Taiwan, "Showa For Medical", Oct. 16, 2014, Taiwan.

Kraft, Jennifer C. et al., "Bodyweight support alters the relationship between preferred walking speed and cost of transport," Elsevier B.V., 2023.

Vincent, Heather K. et al., "Role of Antigravity Training in Rehabilitation and Return to Sport After Running Injuries," Arthroscopy, Sports Medicine and Rehabilitation, vol. 4, No. 1., Jan. 2022, pp. e141-e149.

Huang, Chenhui et al., "Method for Estimating Temporal Gait Parameters Concerning Bilateral Lower Limbs of Healthy Subjects Using a Single In-Shoe Motion Sensor through a Gait Event Detection Approach," Sensors MDPI, 2022.

Naylon, Jordyn A. et al., "Novice Users of a Bodyweight-Supporting Treadmill Require Familiarization," Journal of Sport Rehabilitation, 2022, vol. 31, issue 6.

R. Scott Van Zant et al., "Impact of Varying Exercise Intensity on Oxygen Uptake and Cardiovascular Response during Body Weight Supported Treadmill Walking in Healthy Adults," International Journal of Sports Exercise Medicine, 2022 @213.

Lee, David K. et al., "Training on a Lower Body Positive Pressure Treadmill with Body Weight Support does not Improve Aerobic Capacity," International Journal of Exercise Science 14(7), pp. 829-839, 2021.

Fleckenstein, Daniel et al., "Effect of Uphill Running on VO2, Heart Rate and Lactate Accumulation on Lower Body Positive Pressure Treadmills," MDPI Journal of Sports, 2021.

Megan Wagner and Kevin D. Dames, "Making the Grade: An Exploration of Incline Running on a Bodyweight-Supportive Treadmill," Journal of Sport Rehabilitation, vol. 30, issue 6, 2021.

R. Whiteley et al., "Lower limb EMG activation during reduced gravity running on an incline. Speed matters more than hills irrespective of indicated bodyweight," Elsevier B.V., ScienceDirect, Gait Posture, 83 pp. 52-59, 2021.

R. Whiteley et al., "Effect of speed and gradient on plantar force when running on an AlterG treadmill," BMC Sports Science, Medicine and Rehabilitation, 13:34, 2021.

(56) References Cited

OTHER PUBLICATIONS

T. Brussau and R. Oehring et al., "Cardiorespiratory and metabolic responses to exercise testing during lower-body positive pressure running," Journal of Applied Physiology, 128: 778-784, 2020.
D. Fleckenstein et al., "Physiological and Metabolic Reaction to Lower Body Positive Pressure Treadmill Running," German Journal of Sports Medicine, 71, Jan. 2020.
K. Masumoto et al., "Metabolic Costs During Backward Running with Body Weight Support," International Journal of Sports Medicine, 2019.
W. Hoogkamer et al., "A Comparison of the Energetic Cost of Running in Marathon Racing Shoes," Sports Medicine, 48:1009-1019, 2018.
C. T. Brennan et al., "Can anti-gravity running improve performance to the same degree as over-ground running," Journal of Sports Sciences, Mar. 2018.
F. Stucky et al., "The Effect of Lower-Body Positive Pressure on the Cardiorespiratory Response at Rest and during Submaximal Running Exercise," Frontiers of Physiology, vol. 9, Article 34, 2018.
T. Roussos et al., "Muscle activity during locomotion in various inclination surfaces and different running speeds," ACTA Orthopaedica Et Traumatolotica Hellinca, vol. 69, Issue 4, Dec. 2018.
K. Barnes and J. Janecke, "Physiological and Biomechanical Responses of Highly Trained Distance Runners to Lower-Body Positive Pressure Treadmill Running," Barnes and Janecke Sports Medicine, 3: 41, 2017.
C. Temple et al., "Run Economy on a Normal and Lower Body Positive Pressure Treadmill," International Journal of Exercise Science, 10(5), pp. 774-781, 2017.
K. A. Farina et al., "Physiological and Biomechanical Responses to Running on Lower Body Positive Pressure Treadmills in Healthy Populations," Springer Sports Medicine, Jul. 2016.
Ka-Young Lee, MD et al., Physiological Responses During the Lower Body Positive Pressure Supported Treadmill Test, Ann. Rehabil. Medicine, 40(5); 915-923, 2016.
B. Gojanovic et al., "Overspeed HIIT in Lower-Body Positive Pressure Treadmill Improves Running Performance," Medicine & Science in Sports & Exercise, American College of Sports Medicine, 2015.
J. R. Kline et al., "Conversion Table for Running on Lower Body Positive Pressure Treadmills," Journal of Strength and Conditioning Research, 29(3), pp. 854-862, 2015.
McNeil, David K.P. et al., "Oxygen Consumption of Elite Distance Runners on an Anti-Gravity Treadmill," Journal of Sports Science and Medicine, vol. 14, pp. 333-339, 2015.
McNeill, David K.P. et al., "Metabolic Accomodation to Running on a body weight-supported treadmill," European Journal of Applied Physiology, Dec. 2014.
Buono, Michael J. et al., "Alternations in the Rate of Limb Movement Using a Lower Body Positive Pressure Treadmill Do Not Influence Respiratory Rate or Phase III Ventilation," BioMed Research International, Hindawi Publishing, 2014.
Dr. Nikolaos Koutlianos et al., "Indirect estimation of VO2 max in athletes by ACSM's equation: valid or not?," Hippokratia, 17(2), pp. 136-140, 2013.
Gojanovic, B. et al., "Maximal Physiological Parameters during Partial Body-Weight Support Treadmill Testing," Medicine & Science in Sports & Exercise, American College of Sports Medicine, 2012.
Hoffman MD and Donaghe HE, "Physiological Responses to Body Weight-Supported Treadmill Exercise in Healthy Adults," Arch Phys. Med. Rehabil., vol. 82, Jun. 2011.
Schlabs, H. et al., "Oxygen Consumption During Walking and Running Under Fractional Weight Bearing Conditions," Aviation, Space, and Environmental Medicine, vol. 81, No. 6, Jun. 2010.
Grabowski, A.M., Phd, "Metabolic and Biomechanical Effects of Velocity and Weight Support Using a Lower-Body Positive Pressure Device During Walking," Arch Phys. Med. Rehabil., vol. 91, Jun. 2010.
A. Grabowski and R. Kram, "Effects of Velocity and Weight Support on Ground Reaction Forces and Metabolic Power During Running," Journal of Applied Biomechanics, vol. 24, pp. 288-297, 2008.
Gottshall, J. S., "Ground reaction forces during downhill and uphill running," Journal of Biomechanics, 38, pp. 445-452, 2005.
W. Brent Edwards, "Modeling Overuse Injuries in Sport as Mechanical Fatigue Phenomenon," American College of Sports Medicine, Exercise and Sport Reviews, 0091-6331/4604/224-231, 2018.
Firminger, C. R. et al., "Joint kinematics and ground reaction forces in overground versus treadmill graded running," Elsevier, ScienceDirect, Gait & Posture 63, pp. 1109-1113, 2018.
Ryan, M. R. et al., "Comparison of different measures to monitor week-to-week changes in training load in high school runners," International Journal of Sports Science & Coaching, pp. 1-10, Sage Publishing, 2020.
Warden, S. J. et al., "Preventing bone stress injuries in runners with optimal workload," HHS Public Access, Current Osteoporos Rep., 19(3), pp. 298-307, 2022.
Dr. Thor Besier, "The importance of measuring lower limb cumulative load in sport: a mechanobiological approach," I Measure U Ltd., White Pager, 2017.

* cited by examiner

DAP SYSTEM CONTROL AND RELATED DEVICES AND METHODS

CROSS-REFERENCES TO RELATED APPLICATIONS

This application is related to copending U.S. patent application Ser. No. 17/351,236 filed on Jun. 18, 2021, entitled "Unweighting Exercise Equipment", which is a continuation of U.S. patent application Ser. No. 16/016,340 filed on Jun. 22, 2018, entitled "Unweighting Exercise Equipment" (now abandoned), which claims priority to U.S. provisional patent application No. 62/523,363 filed on Jun. 22, 2017 (expired).

This application is also related to copending U.S. nonprovisional patent application Ser. No. 17/688,890 filed on Mar. 7, 2022, entitled "DAP System Adjustments Via Flexible Restraints and Related Devices. Systems and Methods," which claims priority to U.S. provisional patent No. 63/159,697 filed Mar. 6, 2021, entitled, "DAP System Adjustments Via Flexible Restraints and Related Devices, Systems and Methods." This application is further related to co-pending U.S. nonprovisional patent application Ser. No. 17/540,225, filed on Dec. 1, 2021, entitled "Unweighting Enclosure, System and Method for an Exercise Device."

Further, this application is related to the following U.S. nonprovisional patent applications filed on even date herewith identified by title and docket no. including the following:

- Ser. No. 17/964,849 entitled "DAP Platform, integrated Lifts. System and Related Devices and Methods;" and
- Ser. No. 17/965,517 entitled "Height-Adjustable Seal Frame Structure for DAP Exercise System."

In addition, this application is related to the following co-pending U.S. provisional patent applications:

- U.S. app. No. 63/254,969 filed on Oct. 12, 2021, entitled "DAP System, Platform, Integrated Lifts and Related Devices and Methods";
- U.S. app. no. 63/254,972 filed on Oct. 12, 2021, entitled "DAP System, Enclosure, Seal Frame and Related Devices and Methods"; and
- U.S. app. No. 63/255,001 filed on Oct. 12, 2021, entitled "DAP System, Enclosure, Controls and Related Devices and Methods".

Each of the above applications is hereby specifically incorporated by reference in its entirety.

BACKGROUND

Aspects, features, and concepts described herein relate to supplemental equipment for exercise and rehabilitation devices, and particularly to equipment known as unweighting, antigravity, or differential air pressure (DAP) systems, devices and method, as well as to related devices, systems and methods for use with DAP systems and devices.

Systems for unweighting individuals for rehabilitation and fitness training have been a popular modality. Traditional methods have included aquatic training and using a hoist to lift a person or animal off a walking surface. Harness and hoist systems provide benefits related to their historical use in that they are well-known and can also allow for precise and granular unweighting, but become significantly uncomfortable at off-loading greater than about 25% of normal body weight. Further, aquatic systems can be difficult to control in terms of degree of off-loading, and are cumbersome to use along with having large space and resource requirements.

Systems that create a pressure differential can vary pressure differentials more precisely and are easier to use allowing for a wide range of unloading in small steps. One benefit of this is in the case of rehabilitation, for which it has been shown that increments as small as 1% of normal body weight can effectively determine and bypass a pain threshold below which a user can exercise pain free. More recently, systems creating a pressure differential across a portion of a user have been developed and are generally in commercial use in the rehabilitation and training centers around the world. These systems apply a pressure difference at a portion of the user's body with a net force at the center of pressure. If the net pressure differential is oriented parallel with the force of gravity and located near the user's waist, this off-loading force acts approximately directly counter to the force of gravity and therefore minimally alters the users natural gait patterns.

DAP systems have been commercialized by companies like Showa Denki in Japan, Sasta Fitness of the UK, Vacuwell of Poland, and AlterG Inc. in the US. While these systems offer benefits, they are expensive, large, non-adjustable, require specialized power sources, or are generally limited in access to the market because of the high cost and space burden, or general discomfort in design for users of different body types or heights.

Conventional DAP systems rely on the use of a shell placed around an existing treadmill or similar exercise device. A completely separate chamber is formed that encompasses a base portion of the exercise equipment including the running bel/rollers/deck of a treadmill or the seat and pedals of a stationary bicycle placed inside. These structures duplicate the framing of the combined system and therefore increase the cost, size, shipping bulk, part count, and overall complexity of the system. Further, such conventional DAP systems limit user adjustment of the corresponding exercise device including modifying incline or tilt settings, which impacts the pressure differential of conventional DAP systems.

Further, conventional DAP Systems lack convenience routines for effectively assisting users with initial setup and installation within the DAP system—especially for operating the system alone, as well as simple safety routines, such as quick disconnect options for immediately disconnecting lift mechanisms. In addition, conventional DAP Systems focus on rehabilitation routines and treatments, and fail to provide expanded options for general consumer usage and custom interests. Despite such focus on rehabilitation routines and treatments, conventional DAP systems fail to integrate and take advantage of Thus, needs exist for overcoming various drawbacks and limitations of conventional DAP systems including improving system performance, functionality and user comfort and safety during use. Further, needs exist for DAP enclosures for providing low volume benefits without sacrificing user freedoms of movement, and for effective support connections and interfaces with DAP system enclosures having minimal risks of user discomfort during exercise.

SUMMARY

This summary introduces certain aspects of the embodiments described herein to provide a basic understanding. This summary is not an extensive overview of the inventive subject matter, and it is not intended to identify key or critical elements or to delineate the scope of the inventive subject matter.

A differential air pressure (DAP) control system computer of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. According to aspects and features described herein, a method for controlling a differential air pressure (dap) system during use by a user is provided. The method can be performed on a DAP system including an inflatable enclosure having a base extending upward when inflated from the base to a top opening defined therein and configured for attachment with a user seal interface. The DAP system for the method can further include a platform retaining an exercise device within a cavity defined therein and securing the enclosure base above the exercise device for enabling user access to the exercise device, and a pair of powered vertical lifts secured to opposite lateral sides of the platform at a mid-region proximate the top opening that each have a vertically drivable carriage. In addition, the DAP system for the method can include a seal frame connected to each carriage at opposite ends, in which the seal frame extends about the top opening and is attached to the enclosure at an offset distance from the top opening. The control system computer can be operatively connected to the exercise device, an inflation source coupled to the DAP system in an airtight connection, and the pair of powered lifts. A user seal worn by a user can include an interface configured for secure, airtight attachment with the top opening during use of the DAP system for unweighting the user and enabling user access to the exercise device during a user session for the method.

The method can include calculating a user seal interface height based on an estimated height for the user, and determining, based on the user seal interface height, an attachment carriage height, and a usage carriage height different than the user seal interface height. The method can further include driving the powered vertical lifts to raise each carriage to an attachment position at the attachment carriage height while the user is positioned in the dap system through the top opening, such that the driving can include raising about the user the seal frame attached to the carriages and thereby raising the top opening attached to the seal frame at the offset distance. The method can further include controlling the powered vertical lifts to retain the attachment position during user seal attachment to the top opening, and confirming attachment of the user seal interface to the top opening. In response to the confirming attachment, the method can include driving the powered vertical lifts to move each carriage to a usage position at the usage carriage height. Further, inflating the enclosure can include operating the pressure source to inflate the enclosure to an unweighting pressure and controlling the lifts to retain the usage position. Other arrangements pertaining to these aspects and features can include corresponding computer systems, apparatus, and computer programs recorded on one or more computer storage devices, each configured to perform the actions of the method and method actions.

Implementations can include one or more of the following aspects and features. Actions of the method can be performed such that the attachment carriage is substantially the same as the usage carriage height. Further, actions of the method can be performed such that the attachment carriage height is different from the usage carriage height. The determining the attachment carriage height and the usage carriage height can further include: determining an offset height between a middle portion of the seal frame and connections of the seal frame to each of the carriages, in which the seal frame middle portion extends about the top opening and is attached to the enclosure at the offset distance from the top opening; determining the offset distance between the seal frame attachments to the enclosure and the top opening; and calculating the usage carriage height based on the user seal interface height, the offset height, and the offset distance. The calculating the user seal interface height can include receiving an input of an estimated height for the user, and computing the user seal height as forty-five percent (45%) to sixty (60%) of the estimated height for the user. The computing the user seal height further can include computing the user seal height as about fifty-five percent (55%) of the estimated height for the user. The computing the calculating the user seal interface height further can include: receiving at least one estimated anthropomorphic category for the user, which can an estimated leg height percentile and an estimated age; and computing the user seal interface height as greater, less than, or about fifty-five percent according to the at least one estimated anthropomorphic category. Implementations of the described techniques can include hardware, a method or process, or computer software on a computer-accessible medium.

A differential air pressure (DAP) control system computer of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. According to aspects and features described herein, a method for controlling a differential air pressure (dap) system during use by a user is provided. The method can be performed on a DAP system including a platform having a cover defining an access opening into an internal cavity defined within the platform and a treadmill retained by the platform within in the internal cavity, in which the treadmill substantially exposes a top treadmill surface through the access opening. The DAP system for the method can further include an inflatable enclosure having a base defining a base opening secured to the cover about the access opening and extending upward to a top opening defined therethrough, and a pair of powered vertical lifts connected to opposite sides of the platform along a longitudinal mid-region proximate the top opening each having vertically drivable carriage. Further, the DAP system for the method can include a seal frame having a pair of opposite restraint connectors, a pair of flexible tensile restraints each attached at one end to a corresponding restraint connector and at an opposite end to a corresponding carriage, and a user seal worn by a user having a user seal interface configured for attaching to the inflatable enclosure at the top opening when the user extends through the top opening and engages the top treadmill surface for using the DAP system in an unweighting condition. The method can include determining a user seal interface height for the user, and determining a usage carriage height based on the user seal interface height for the user, in which the user seal interface height can be different from the usage carriage height. In addition, the method can include raising each carriage to a user seal attachment position higher than the usage carriage height for attachment of the user seal interface to the enclosure, and lowering each carriage to the usage carriage height, as well as confirming inflation conditions are met including attachment of the user seal interface to the inflatable enclosure at the top opening. Additionally, the method can include inflating the enclosure to an inflated condition, and restraining the user seal interface at the user seal interface height including restraining the seal frame at a seal frame height according to the usage carriage height. Other arrangements according to such aspects and features can include corresponding computer systems, apparatus, and computer programs recorded on one or more computer storage devices, each configured to perform the actions of the methods.

Implementations can include one or more of the following features. Actions of the method for determining the user seal interface height can include one of: (i) calculating the user seal interface height for the user based on a user input of a height feature of the user, in which the height feature can include one of a user height estimate and a height feature for the user different from the user height, such that the height feature can be different from the user height and the calculating further can include estimating a user height according to the height feature; (ii) setting the user seal interface height for the user to a previous user seal interface height for a previous DAP system used by the user; and (iii) determining the user seal interface height for the user based on one of (i) and (ii) and further based on a modification factor input for the user. The method action (i) can further include; calculating the user seal interface height as forty-five percent to sixty percent of one of the user height estimate input by the user and the estimated user height. In addition, the calculating can include calculating the user seal interface height as about fifty-five percent of the user height estimate input by the user or the estimated user height.

In some implementations, the pair of restraints can define a restraint height in the inflated condition, and the restraint height can include a vertical distance between each flexible tensile restraint attachment to a corresponding restraint connector and attachment to the corresponding carriage. Further, the determining the usage carriage height can include: subtracting from the user seal interface height the restraint height. In the inflated condition the seal frame defines a user seal interface boundary region between the seal frame and the user seal interface, such that the boundary region extends upward from the seal frame in the inflated condition and defines a vertical drop distance from the user seal interface to regions of the seal frame disposed about the user seal interface. Further, a middle region of the seal frame can be disposed about the seal frame interface, and the middle region can be vertically offset from the pair of opposite restraint connectors. Further, the determining the usage carriage height can include: subtracting the vertical drop distance from the user seal interface height; and subtracting the middle region offset height from the user seal interface height.

In some implementations, the method can further include: detecting a critical error; and stopping at least one of treadmill operations, lift operations, and enclosure inflation operations. Upon determination that the detected enclosure pressure exceeds the predetermined threshold, the stopping can include: stopping treadmill operations; interrupting any lift operations; and deflating the enclosure. Upon determination that at least one of the detected enclosure pressure, the determined vertical offset and the current draw for each drive motor exceeds the corresponding predetermined threshold, the stopping can include at least one of the following: stopping treadmill operations; interrupting each of the drive motor operations; and deflating the enclosure.

Further, in some implementations, the adjusting can include each drive motor driving vertical movement of each lift downward from the usage carriage height to a lower modified usage carriage height, and the method can further include: stopping treadmills operations prior to performing the adjusting. In some implementations, the DAP system further can include at least one user-removable coupling connector connecting each seal frame restraint connector to the corresponding carriage. As such, the detecting the critical error can include detecting disconnection of the at least one user-removable coupling connector, and the stopping can include stopping any treadmill operations, lift operations, and enclosure inflation operations. In some implementations, the method can include: calculating output and cumulative load for the user during usage of the DAP system, and providing calculated output and cumulative load information to the user for at least one of a user session on the DAP system; historical calculated and cumulative load information for the user; and updated historical calculated and cumulative load information, which can include the historical calculated and cumulative load information updated for the user session. The calculating output and cumulative load for the user can include performing calculations that can include: average calories (kcal/min)=(1−((0.1302*% bw)+1.2045))*(3.5+(0.2*v)+(0.9*v*g))/3.5; total calories=average calories*workout duration in minutes, where: % bw=body weight % (in decimal form); v=velocity in meters/min; and g=% gradient (in decimal form); such that average power (watts) average calories*69.5; and total work (kj) (average power*workout duration in seconds)/100). Implementations of the described techniques can include hardware, a method or process, or computer software on a computer-accessible medium.

A differential air pressure (DAP) control system computer of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. According to aspects and features described herein, a method for controlling a differential air pressure (DAP) system during use by a user is provided. The method can be performed on a DAP system including an inflatable enclosure and an exercise device for controlling a treatment method performed with the DAP or unweighting system that is operatively connected with the exercise device and a blood flow restriction (BFR) system configured for selectively occluding blood flow to a user's limb during a treatment session. The exercise treatment method can include controlling a blood flow restriction (BFR) cuff of the BFR system wrapped around a portion of a leg or other limb of the user to exert compression on the portion of the leg for occluding blood flow to the leg at a first percentage limb occlusion pressure (lop) for the leg during the treatment session.

The method can further include pressurizing the inflatable enclosure at a first pressure level for unweighting a percentage of the user's weight during the treatment session, and in response to a control action occurring, performing a response control action, in which each of the control action and the response control action includes one of a BFR control action and an unweighting control action. The BFR control action can include controlling the BFR cuff based on occluding blood flow a second percentage LOP different from the first percentage LOP, and the unweighting control action can include adjusting pressure of the inflatable enclosure to a second pressure level different from the first pressure level. In some implementations, the control action can include the BFR control action in which the second percentage LOP is less than the first percentage LOP, and the response control action can include the unweighting control action in which the second pressure level is lower than the first pressure level. Further, the control action can include the unweighting control action, in which the second pressure level is greater than the first pressure level, and the response control action can include the BFR control action, in which the second percentage LOP is greater than the first percentage LOP. In addition, the control action can include the BFR control action, in which the second percentage LOP is greater than the first percentage LOP, and the response control action can include the unweighting control action, in which the second pressure level is greater than the first pressure level. Also, the control action can include the unweighting control action, in which the second pressure level is lower than the first pressure level, and the response control action can include the BFR control action, in which the second percentage LOP is lower than the first percentage LOP. Other arrangements according to such aspects and features can include corresponding computer systems, apparatus, and computer programs recorded on one or more computer storage devices, each configured to perform the actions of the methods.

Other exercise-related support devices, related systems, and components, and/or methods according to embodiments will be or become apparent to one with skill in the art upon review of the following drawings and detailed description. It is intended that all such additional devices, related components, systems, and/or methods included within this description be within the scope of this disclosure.

DETAILED DESCRIPTION

Figure 1:
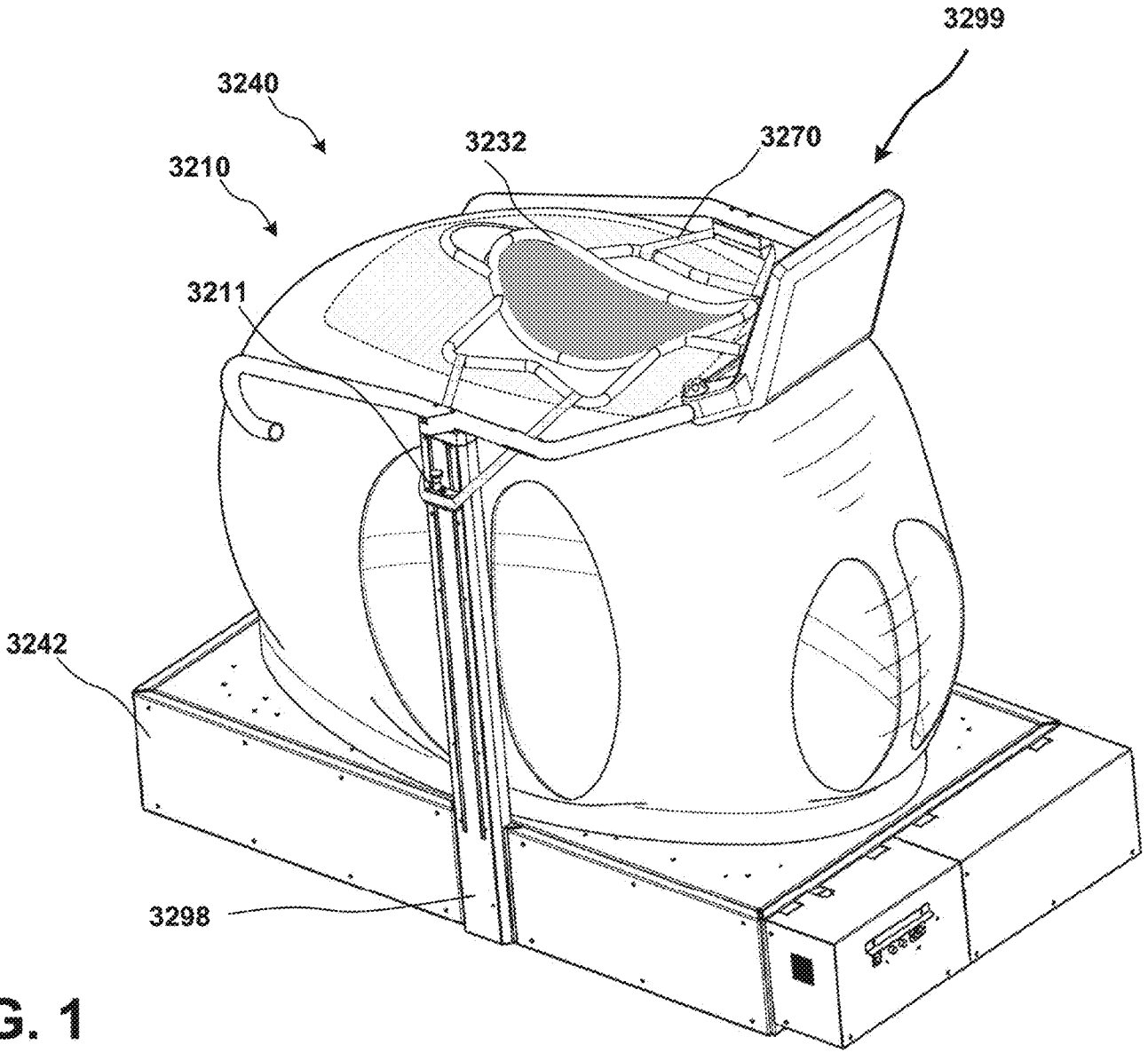
FIG. 1 is a top perspective view of an example schematic representation of a DAP System supporting system operations for a flexible movement, inflatable enclosure of the DAP System secured by a platform and an optional hybrid framework and having height adjustment supports, which example system can support a wide range of system operations and optional functions in accordance with aspects and features described herein.

For the purposes of promoting an understanding of the aspects, features and principles pertaining to the invention and configurations discussed herein, reference will now be made to the example configurations and arrangements illustrated in the drawings along with language describing the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one arrangement," "an arrangement," or similar language means that a particular feature, structure, or characteristic described in connection with the arrangement is included in at least one arrangement of the present invention. Thus, appearances of the phrases "one arrangement," "an arrangement." and similar language throughout this specification can, but do not necessarily, all refer to the same arrangement, different arrangements, or component parts of the same or different illustrated invention. Additionally, reference to the wording "an arrangement," or the like, for two or more features, elements, etc. does not mean that the features are related, dissimilar, the same, etc. The use of the term "an arrangement," or similar wording, is merely a convenient phrase to indicate optional features, which may or may not be part of the invention as claimed.

Each statement of an arrangement is to be considered independent of any other statement of an arrangement despite any use of similar or identical language characterizing each arrangement. Therefore, where one arrangement is identified as "another arrangement," the identified arrangement is independent of any other arrangements characterized by the language "another arrangement." The independent arrangements are considered to be able to be combined in whole or in part one with another as the claims and/or art may direct, either directly or indirectly, implicitly, or explicitly.

Finally, the fact that the wording "an arrangement," or the like, does not appear at the beginning of every sentence in the specification, such as is the practice of some practitioners, is merely a convenience for the reader's clarity. However, it is the intention of this application to incorporate by reference the phrasing "an arrangement." and the like, at the beginning of every sentence herein where logically possible and appropriate.

References for "herein" or similar terminology including "used herein," "shown herein" or "discussed herein" are understood to mean the instant patent application, as well as all related patent applications incorporated by reference and/or identified in the present application. Further, references for "herein: and the like are understood to include anticipated patent application filings for related subject matter and improvements including provisional or non-provisional patent applications that denote, identify or incorporate by reference the instant patent application.

As used herein, "comprising," "including," "contaning," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

As used herein, the term "about" when used in connection with a referenced numeric indication means the referenced numeric indication plus or minus up to 10 percent of that referenced numeric indication. For example, the language "about 50" covers the range of 45 to 55. Similarly, the language "about 5" covers the range of 4.5 to 5.5.

As used in this specification and the appended claims, the words "top," "above," and "upward" refer to elevation directions away from the ground level of an exercise device in its typical or intended usage orientation at or towards a higher elevation, and the words "bottom." "below." "base" and "downward" refer to elevation directions at or towards the ground level of an exercise device at a lower elevation in its typical usage orientation. Thus, for example, the top of a structure for an exercise device that is farthest from the ground level of the exercise device would be the vertical distal end of the structure, and the end opposite the vertical distal end (i.e., the end interfacing with the exercise device closest to ground level) would be the vertical base or bottom end of the structure.

Further, specific words chosen to describe one or more arrangements and optional elements, or features are not intended to limit the invention. For example, spatially relative terms—such as "beneath," "below," "lower," "above," "upper," "proximal," "distal," and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures were turned over, elements described as "below", or "beneath" other elements or features would then be "above" or "over" the other elements or features. Thus, the term "below" can encompass both positions and orientations of above and below. A device may be otherwise oriented (e.g., rotated 90 degrees or at other orientations) and the spatially relative descriptors used herein interpreted accordingly. Likewise, descriptions of movement along (translation) and around (rotation) various axes include various spatial device positions and orientations.

Similarly, geometric terms, such as "parallel," "perpendicular," "round," "curvilinear." "articulated" or "square," are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a," "an," and "the" are intended to include the plural forms as well, unless the context indicates otherwise. The terms "comprises," "includes," "has," and the like specify the presence of stated features, steps, operations, elements, components, etc., but do not preclude the presence or addition of one or more other features, steps, operations, elements, components, or groups.

Unless indicated otherwise, the terms exercise apparatus, device, equipment, systems, and variants thereof, can be interchangeably used.

In this specification, the applicant may refer to an exercise machine and an existing exercise machine. The reader shall note that the distinction is that an existing exercise machine may already be designed prior to consideration for use of the same with a DAP system and an existing exercise machine may further already be installed in the field, for example in a gym, training facility, etc. The reader shall interpret minor modifications of the exercise machine or existing exercise machine for use with a DAP system as still part of the exercise machine and still within the spirit of the scope of the subject matter disclosed. Further, although many examples related to a DAP System or example DAP System are shown and discussed along with example treadmill exercise devices or equipment, it is understood that the application and invention are not so limited and various other types of exercise devices or equipment could replace the example treadmill devices or equipment.

As used herein, an "independently-supportable" inflatable enclosure refers to an inflatable enclosure formed from a substantially inelastic material defining a base opening configured for being secured to a base support, configured to form an airtight connection with an air supply, and defining a top port configured to form an airtight connection with a user interface such that, when inflated, secured to the air supply, and forming an airtight connection with a user, the inflatable enclosure is capable of independently extending in an upward direction from the base support and provide unweighting forces on the user without requiring a support framework, hybrid framework or other attachments or connections with support members regardless of whether the inflatable enclosure makes contact with a supplemental support member. As such, an independently supportable inflatable enclosure forms a hollow, thin-shelled inflatable support enclosure extending from secure attachment with the base support upward to the top port and user interface.

In accordance with a general aspect of concepts discussed herein, an inflatable unweighting enclosure for an exercise device is provided along with methods for controlling the same having a top port or opening formed therein, a corresponding hoop-shaped seal frame that can include a top frame or seal frame outlining the opening, and optionally a hybrid framework that can be selectively attached to the seal frame via a plurality of outboard-extending, ascending or vertically oriented tensile restraints while in the inflated state disposed about a horizontal perimeter portion of the enclosure. The seal frame can be configured to interface with a user's harness or other user interface and form a support connection therewith during use of the unweighting enclosure, in which the user extends into and through the top port and top bracket. Further, fixed connection arrangements for the hybrid transverse framework and lift components are further described herein along with control actions and operations for the same.

In accordance with various aspect and features of inventive concepts discussed herein, the inflatable enclosure can be configured to be self-supporting beyond its attachment at its base, such that configurations of the inflatable enclosure can inflate and operate without including a hybrid framework or other skeletal frame members arranged to restrain, modify and/or significantly shape the enclosure. Such a beneficial arrangement can allow operation of the DAP at lower pressures and/or applications of forces than conventional DAP systems, and thereby significantly reduce risks associated with usage, as well as provide enhanced freedoms of movement for the user.

Example DAP System Having a Lifting System and Selectively Actuated Hybrid Framework for Supporting Example DAP System Operations & Methods Referring now to FIGS. 1 to 4, an example DAP System 3240 is generally shown having a platform 3240, an enclosure 3210 attached at its base thereto, a pair of vertical lifts 3296, 3298 integrally attached at base ends to the platform, and a seal frame 3232 attached to the enclosure at a top port thereof, in which a lifting system 3299 is formed via the pair of vertical lifts 3296, 3298 integrated with the platform 3240 at their base ends and attached to opposite sides of the seal frame 3232. The lifting system can connect with the seal frame 3232 via opposing pairs of flexible, high tensile strength restraints 3270 for performing initial lift operations and for selective connection with opposite sides of the seal frame 3232 in a hybrid support for using the DAP System. DAP System 3240 generally includes the same aspects and features DAP systems identified at the beginning of this specification and specifically incorporated herein by reference.

Figure 3:
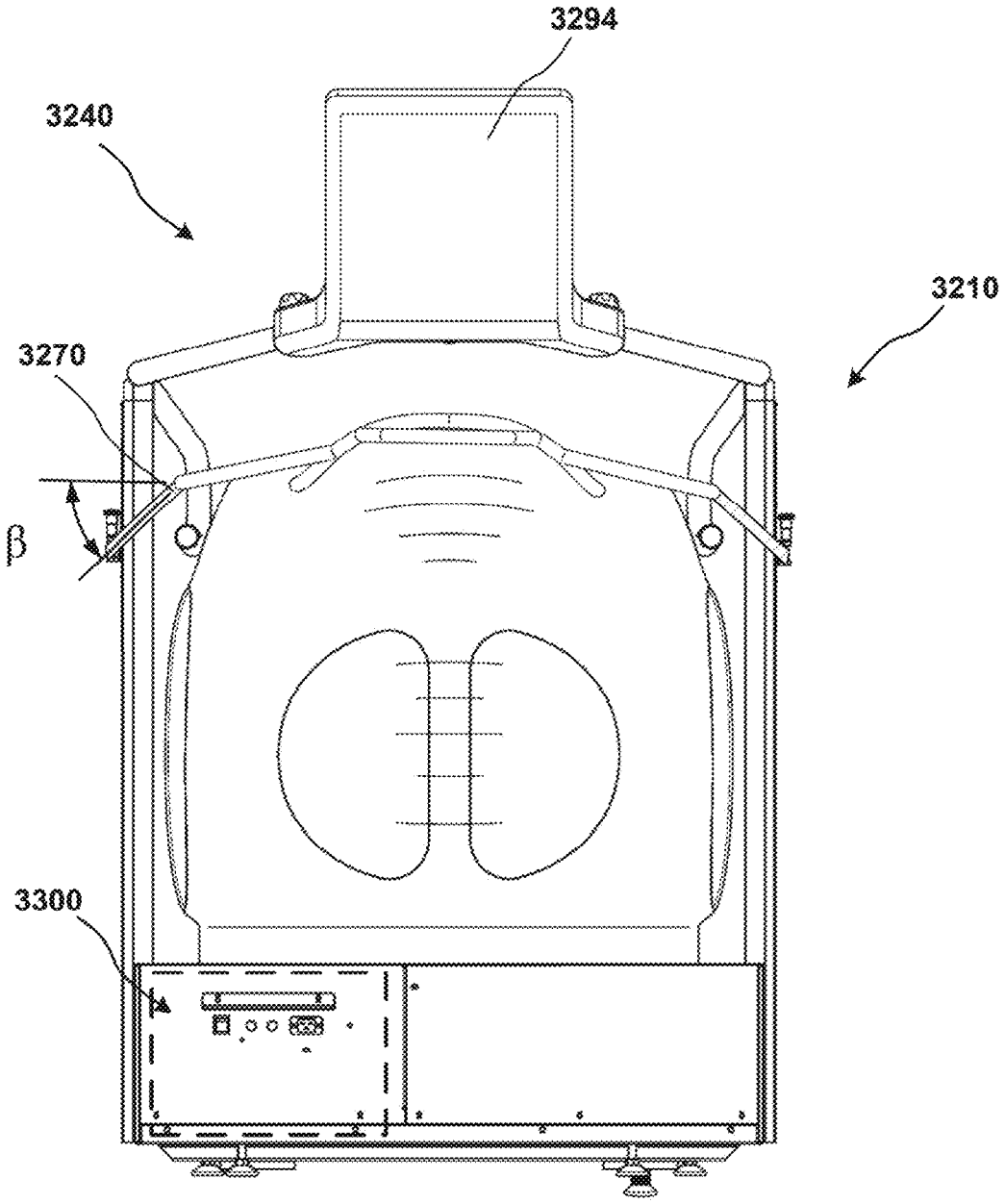
FIG. 3 is a front view of the DAP System of FIG. 1.
Figure 4:
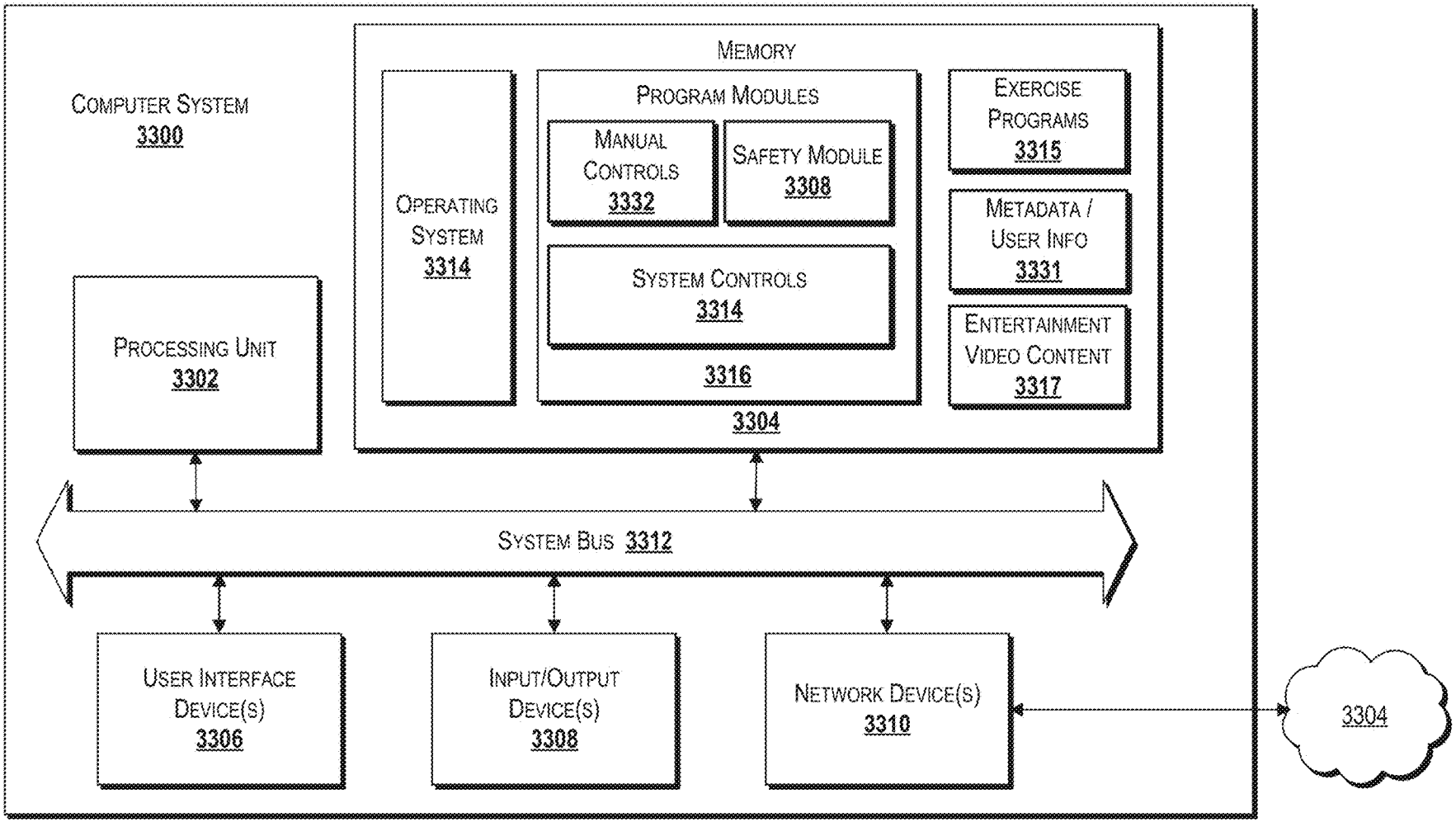
FIG. 4 is an example schematic representation of a computer control system for the DAP System of FIG. 1 arranged for controlling system operations and performing related functions and optional routines according to aspects and features described herein.

As shown in FIGS. 3 and 4, DAP System 3240 includes a control system 3300 that can be located in part in a portion of platform 3242 or other convenient location, such as at a front portion of the platform. It is understood that portions of control system 3300 can be distributed throughout the DAP System including components and portions located within monitor 3294 and at other locations. Further, it is understood that components and portions of control system 3300 can include sensors, limit switches, motor interfaces such as motors for driving the vertical lifts, and the like, which as discussed below can be arranged as a considered as a block diagram as computer system 3300.

Example Computer Control System

Referring now to FIG. 4, a block diagram is shown illustrating a computer system 3300 configured generally to provide the functionality described herein, as examples, for: Controlling operations of a DAP System including initialization of the corresponding inflatable enclosure for a user, monitoring and controlling operations of the exercise device and inflatable enclosure along with other system components; Interacting with the user: and Performing shutdown operations in accordance with aspects and features of subject matter discussed herein. In some arrangements, the architecture shown in FIG. 4 can correspond to the devices illustrated and described herein with respect to the DAP System control panel or control device, though this is not necessarily the case. The computer system 3300 includes a processing unit 3302, a memory 3304, one or more user interface devices 3306, one or more input/output ("/O") devices 3308, and one or more optional network devices 3310, each of which is operatively connected to a system bus 3312. The bus 3312 enables bi-directional communication between the processing unit 3302, the memory 3304, the user interface devices 3306, the I/O devices 3308, and the network devices 3310.

It is understood that the block diagram is illustrative various different options for implementation of computer control system 3300. For instance, in one implementation, a RASPBERRY PI Microcontroller running on the ANDROID operating system can be located in the console area. A main control hub thereof can be arranged for controlling the lift monitors and communicating general DAP System controls including a blower controller for blower monitoring and controls between the RASPBERRY P and a blower controller and treadmill controller, which can cooperate with a treadmill exercise system for controlling subsystem management (maintaining target speed, etc). These various circuit boards or modules can be separate or combined and be located in various parts of the DAP system such as in the console area, or one or more bottom enclosures.

The processing unit 3302 may be a standard central processor that performs arithmetic and logical operations, a more specific purpose programmable logic controller ("PLC"), a programmable gate array, or other type of processor known to those skilled in the art and suitable for controlling the operation of the DAP system functionality. As used herein, the word "processor" and/or the phrase "processing unit" when used with regard to any architecture or system can include multiple processors or processing units distributed across and/or operating in parallel in a single machine or in multiple machines. Furthermore, processors and/or processing units can be used to support virtual processing environments. Processors and processing units also can include state machines, FPGAs, micrcontrollers, application-specific integrated circuits ("ASICs"), combinations thereof, or the like. Because processors and/or processing units are generally known, the processors and processing units disclosed herein will not be described in further detail herein.

The memory 3304 communicates with the processing unit 3302 via the system bus 3312. In some arrangements, the memory 3304 is operatively connected to a memory controller (not shown) that enables communication with the processing unit 3302 via the system bus 3312. The memory 3204 includes an operating system 3214 and one or more program modules 3216, which can include system controls 3214 for controlling operations of the DAP System, a safety module for detecting safety concerns and taking appropriate actions, and manual controls 3232 for enabling sets of user commands in accordance with safety parameters and system status. The operating system 3314 can include, but is not limited to, Android or iOS, members of the WINDOWS, WINDOWS CE, and/or WINDOWS MOBILE families of operating systems from MICROSOFT CORPORATION, the LINUX family of operating systems, the SYMBIAN family of operating systems from SYMBIAN LIMITED, the BREW family of operating systems from QUALCOMM CORPORATION, the MAC OS, iOS, and/or LEOPARD families of operating systems from APPLE CORPORATION, the FREEBSD family of operating systems, the SOLARIS family of operating systems from ORACLE CORPORATION, other operating systems, and the like.

The program modules 3316 may include various software and/or program modules for enabling or performing actions described herein, such as initialization actions for initial setup prior to and through inflation of the inflatable enclosure. In some arrangements, for example, the program modules 3316 can operate a Safety Module 3308 for performing Lift and Safety Restraint controls. These and/or other programs can be embodied in computer-readable media containing instructions that, when executed by the processing unit 3302, perform one or more of the methods related to subject matter describe herein and related applications including methods 3710, 3910, 4010 and 4210 described hereafter along with FIGS. 7 and 11 to 13. The program modules 3316 may be embodied in hardware, software, firmware, or any combination thereof. Although not shown in FIG. 4, it should be understood that the memory 3304 also can be configured to store user settings and preferences data, historical usage data including previous usage settings, user interface data, metadata 3331, exercise programs for usage of the exercise device, entertainment and/or video content 3317, and/or other data, if desired.

By way of example, and not limitation, computer-readable media may include any available computer storage media or communication media that can be accessed by the computer system 3300. Communication media includes computer-readable instructions, data structures, program modules, or other data in a modulated data signal such as a carrier wave or other transport mechanism and includes any delivery media. The term "modulated data signal" means a signal that has one or more of its characteristics changed or set in a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

Computer storage media includes volatile and non-volatile, removable and non-removable media implemented in any method or technology for storage of information such as computer-readable instructions, data structures, program modules, or other data. Computer storage media includes, but is not limited to, RAM, ROM, Erasable Programmable ROM ("EPROM"), Electrically Erasable Programmable ROM ("EEPROM"), flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer system 3300. In the claims, the phrase "computer storage medium" and variations thereof does not include waves or signals per se and/or communication media.

The user interface devices 3306 may include one or more devices with which a user accesses the computer system 3300. The user interface devices 3306 may include, but are not limited to, computers, servers, personal digital assistants, cellular phones, or any suitable computing devices, as well as through touch screen and/or dedicated interface devices associated with monitor 3294 (FIG. 3). The I/O devices 3308 enable a user to interface with the program modules 3316. In one arrangement, the I/O devices 3308 are operatively connected to an I/O controller (not shown) that enables communication with the processing unit 3302 via the system bus 3312. The I/O devices 3308 may include one or more input devices, such as, but not limited to, a keyboard, a mouse, an electronic stylus, and/or touchscreen functionality, external buttons, rotary encoder knobs, heart rate monitors etc. Further, the I/O devices 3308 may include one or more output devices, such as, but not limited to, a display screen including monitor 3294.

The network devices 3310 enable the computer system 3300 to communicate with other networks or remote systems via a network, such as wireless network. Examples of the network devices 3310 include, but are not limited to, a modem, a radio frequency ("RF") or infrared ("IR") transceiver, a telephonic interface, a bridge, a router, or a network card. The network 104 may include a wireless network such as, but not limited to, a Wireless Local Area Network ("WLAN") such as a WI-FI network, a Wireless Wide Area Network ("WWAN"), a Wireless Personal Area Network ("WPAN") such as BLUETOOTH, a Wireless Metropolitan Area Network ("WMAN") such a WiMAX network, or a cellular network. Alternatively, the network may be a wired network such as, but not limited to, a Wide Area Network ("WAN") such as the Internet, a Local Area Network ("LAN") such as the Ethernet, a wired Personal Area Network ("PAN"), or a wired Metropolitan Area Network ("MAN").

Control computer system 3300 can be coupled with various system devices, optional devices and sensors, supplemental devices and the like to provide a wide range of benefits and perform innovative methods as discussed in greater detail below. Such actions can be conducted as part of core operations for DAP System 3240, as well as part of customized and optional actions and operations.

Example Unweighting Operations

Traditionally, unweighting machines, harness systems and other unweighting devices have used manual lifting systems that require the user to lift the system. The applicant has invented a flexible and independent mechanized lift system to automatically raise and lower a support frame that goes around the user to shape an opening of the inflatable shell, which includes the left and right lifts being decoupled from each other. Examples of such a lift system are described in related applications listed at the beginning of this specification that are incorporated herein by reference.

Referring now to FIGS. 5 to 10 along with FIGS. 1 to 4, the lifting system 3299 generally includes the left lift 3296, the right lift 3298, and an attachment mechanism for each lift to connect and disconnect with opposite sides of the seal frame 3232 having a plurality of flexible, high tensile strength restraints 3270 and release pin 3276 for each side and corresponding lift, which allows the seal frame 3232 to decouple from the mechanized lifting columns 3296, 3298. Further, as best seen along with FIG. 8, seal frame 3232 cam move vertically as whole and independently on each of the left and right side based on connections with each of the left lift 3296 and the right lift 3298 via flexible restraints, as well as based on the low hoop stress curved edge portion extending along the seam and perimeter portions of the joined sheets as discussed herein and along with related patent applications. This added vertical compliance further promotes more natural movement via vertical lifting force during a range of vertical positions of the user seal.

Note that the left lift 3296 and right lift 3298 and related attachment components are designed for universal use on either the left or right side in mirror image arrangements of each other. As such, details shown and corresponding descriptions for each side applies to both left and right side components and features. The attachment mechanism for each lift to connect and disconnect selectively with the seal frame 3232 provides flexible options for use of the DAP System and use of the lifting mechanism 3299 therewith, such as for lift operations alone and/or as a hybrid framework for supporting high inflation usage modes of the DAP System. Further, such a selective use and quick disconnect attachment mechanism promotes safety in the event inadvertent errors or noncompliant conditions, such as the lifting system 3299 becoming stuck, or losing power or in the event of software control errors. As an example, such a release can include a single pin 3276 for each vertical lift 3296, 3298 that is placed through one or more loops in the flexible ropes or other quick release mechanisms as described herein. In the case two separate ropes or restraints 3270 are used per side, this adds another layer of safety redundancy in the event that one rope breaks, the other rope can still hold that side down which is important to prevent the hard seal frame 3232 from popping up quickly due to high pressure. Further, the safety pin can incorporate a secondary pin, or detent, or some action that needs to be released in order to remove the safety pin. This can prevent accidental release of the safety pin. A release mechanism with a pin that allows quick release of the ropes also facilitates easy replacement of the ropes, which allows a customer to self-service the component and feature.

Figure 5:
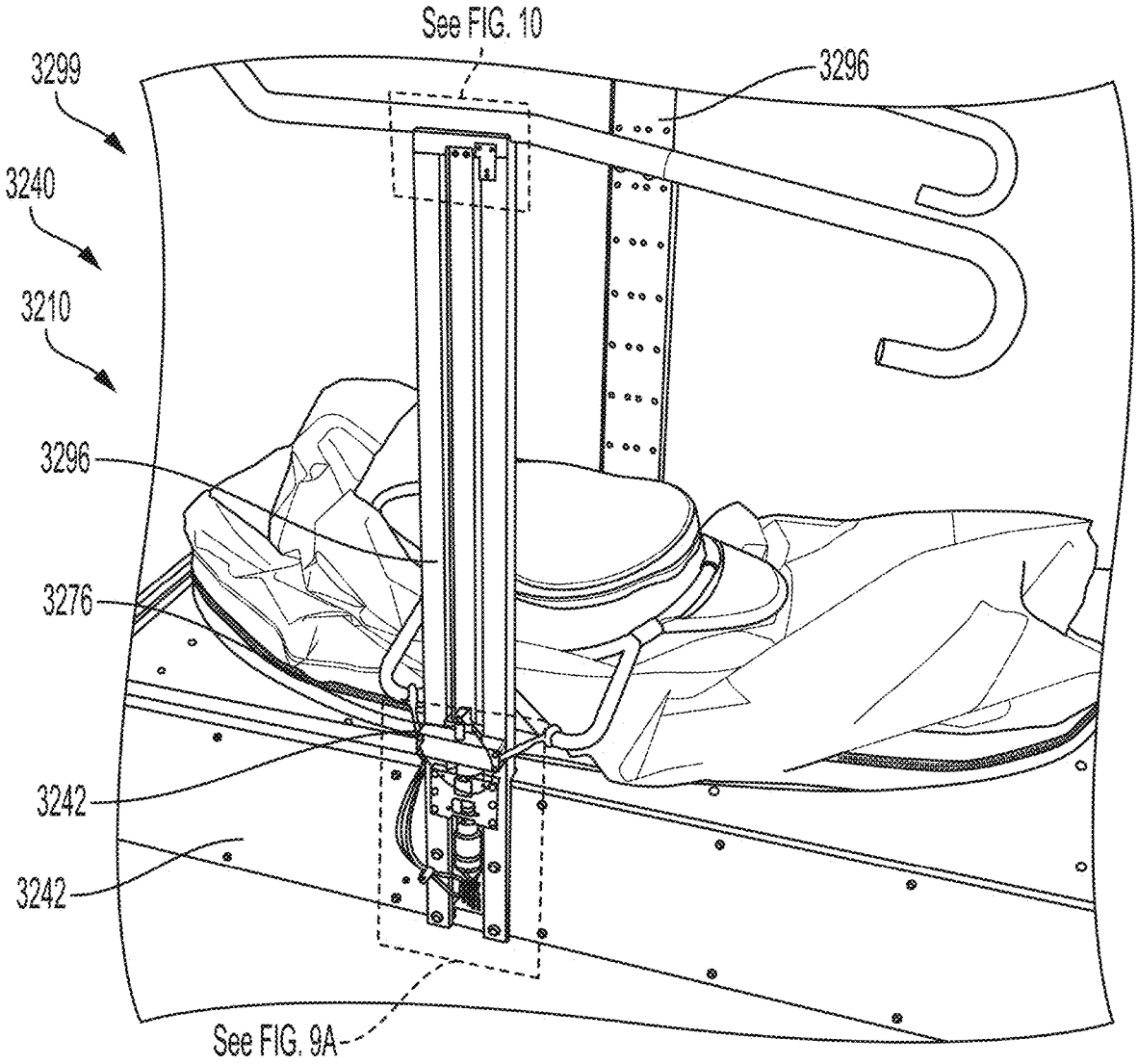
FIG. 5 is a partial left side perspective view of the example DAP System of FIG. 1 shown a base position.
Figure 6:
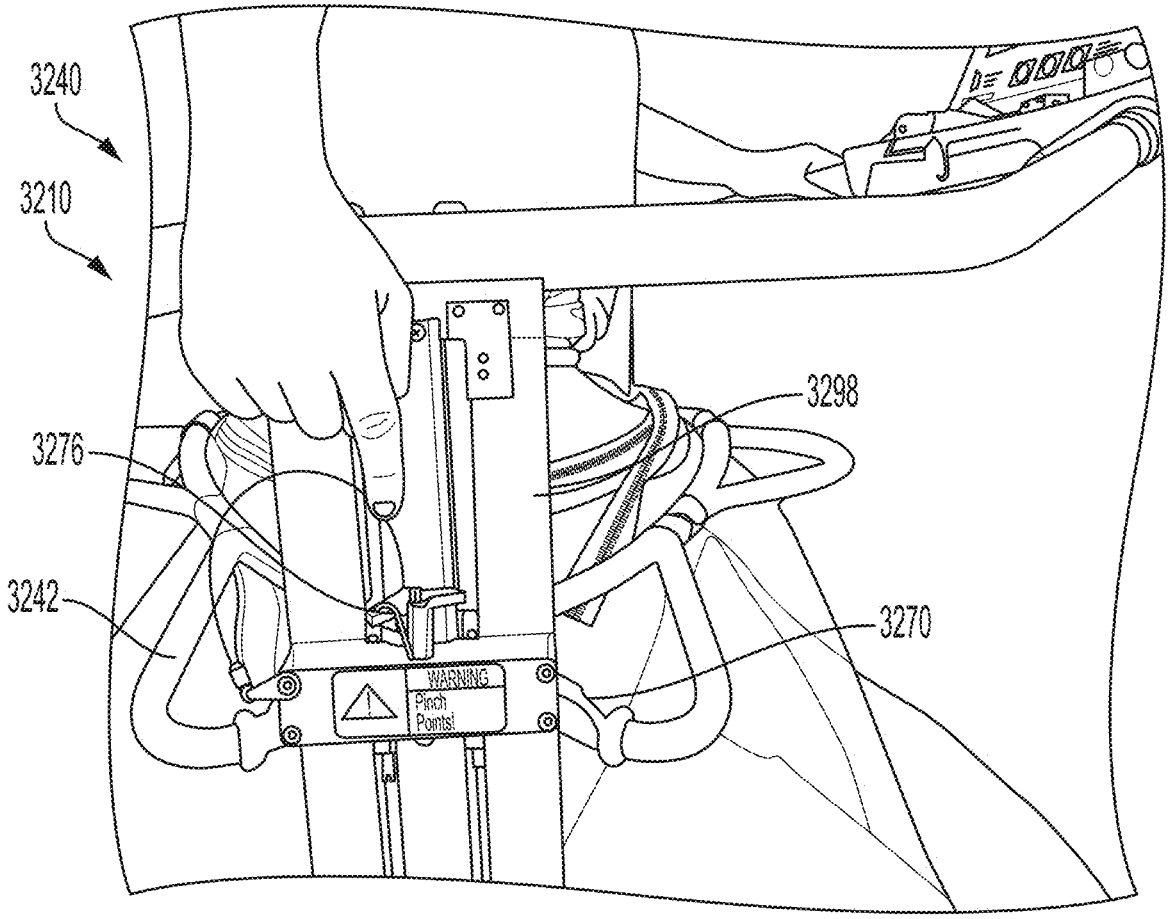
FIGS. 6 and 7 are partial right side views of the example DAP System of FIG. 1 shown with a representative user therein, which depicts example steps of a control routine of the DAP System.
Figure 7:
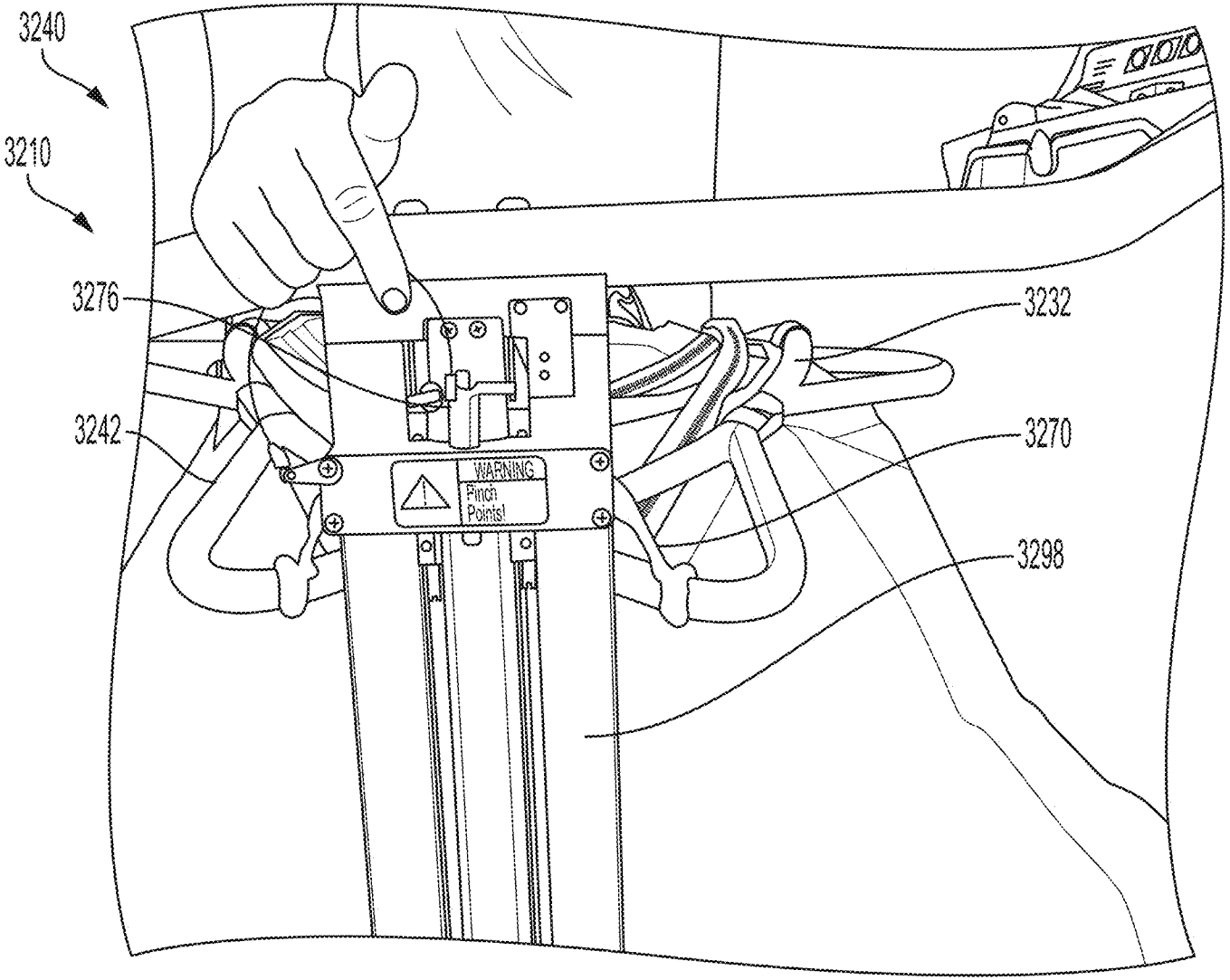

The computer system 3300 can be programmed for initial lift operations as generally depicted in FIGS. 5 to 7 for raising the uninflated enclosure 3210 from a base level via connections with restraints 3270 to automatically adjust the height of the lifting carriage to approximately 55% of the user's height, or in some cases between 50% and 60%, or in other cases 45% to 65%. To facilitate entry and exit, the lift may initially be move higher, to approximately between 50-70% of the user's height, and then automatically moved back down the target height of the ranges previously mentioned. This may facilitate entry and connection to the machine to have the seal frame initially higher during the connection process, but then lower in the proper position to facilitate running and movement and keep the bag out of the way of the arm swing of the user. Further, restraints 3270 can selectively be removed after initial lift and set up operations and prior to full inflation as depicted in FIG. 7 for use of the DAP System 3240 in an independent support mode without having height adjustment features provided via lifts 3296, 3298 or support from the hybrid framework that can be provided via connections with the vertical lifts during use.

Figure 9B:
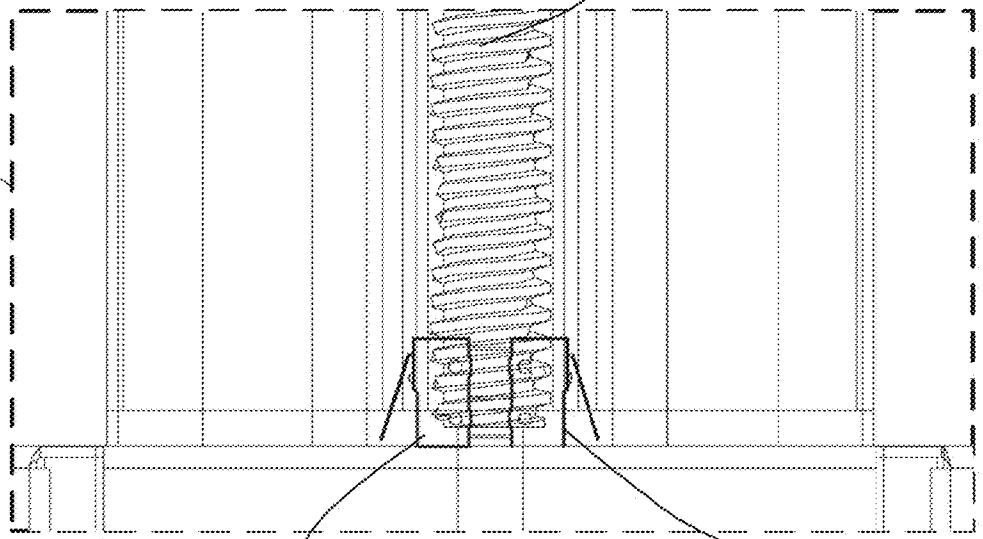
FIGS. 9A, 9B and 9C are Detail Views as indicated along with FIG. 5 for portions of left lift 3296 shown in FIG. 5.
Figure 9A:
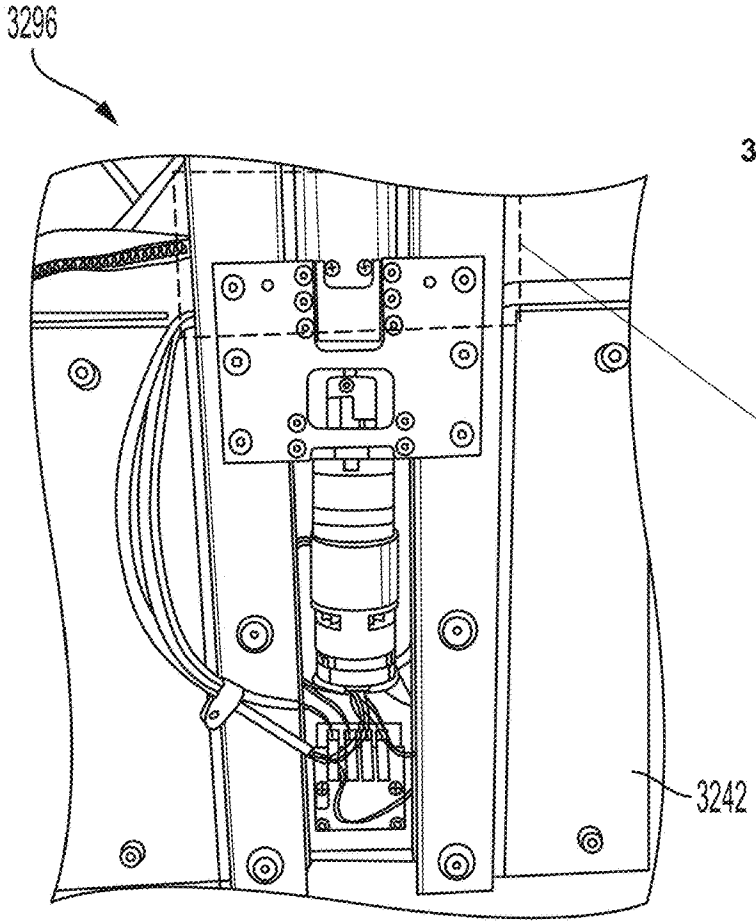

With particular reference to FIGS. 9A to 10, the lift columns can each incorporate one or more limit switches 3278 which signal to the processor that the lift column must turn off or be reversed. In one case (not shown), a first switch may be a software switch (not shown) that signals to the processor controlling the lift system it needs to stop the movement of the carriage and record a zero set point or an upper bound limit. In another case, as second limit switch 3278 may be used as a hardware cutout which physically cuts power to the lift motors to prevent jamming of the lift column and overloading of the motors for fire prevention safety. In such a way, there is double redundancy in the lift column design to prevent jamming and over loading of the motors. In such an arrangement the software limit switch may be located closer to the center of the lift column than the hardware limit switch such it the lift carriage will contact the software limit switch first in both the up and down movements. In other words, there can be one software limit switch at the top and one at the bottom, or there can only be one at the top OR one software limit switch at the bottom since generally the length and number of rotations is known, thus once zeroed, a feedback mechanism such as a rotary encoder may determine the software limit on the side that does not have a software limit switch.

In testing, a beneficial sequence of events was determined for ensuring the lift columns operate safely and consistently. For example, when the system is initially powered, the computer system 3300 may not know where the lifting carriage is located, for which the computer system can control lowering of the lift carriage slowly until it trips the software limit switch (not shown) to signal a baseline zero height. In this scenario, the lifting columns can move at a first slower speed, since the control algorithm doesn't know when to anticipate the switch being tripped and therefore when to slow down the motor. If the lifts are not initially lowered at a slower rate compared with usage rates when operated, the inertia of the system could cause the lift to over-rotate down and jam. However, the slower 'set point' rate used for determining or confirming the zero baseline with low risk of jamming can be too slow for actual operation. If a lift carriage lifts too slowly, it can be annoying to the user and reduce utility of the lift system, therefore the lift system can be designed to operate at a faster second operating speed as well.

Based on research, development and testing, advantageous combinations have been identified for balancing desired motor requirements along with lift parameters such as lead screen diameter, lead screw pitch, lift speed, and providing the same as part of a lift system 3299 that is non-backdrivable. The lift system 3299 having non-backdrivable features can permit operational use of the lift system as a hybrid framework for DAP System operations at high system loads from inflation pressure impacts that cannot readily be retained by the lift column motors and/or without requiring usage of high capacity motors and related lift framework components. Further, for safety purposes, the power to the lift column motors can be arranged to be cut off whenever the lift columns are not in operation in order to ensure that they cannot be overheated due to trying to retain the lifting force and resisting movement of the screw which may be driven by high restraining forces. Further, to prevent the lift columns from operating when the bag is pressurized and thereby exposing the motors to high torque requirements that could overheat them, a system check on the pressure can be done and monitored before the process applies power to the motors to move the lift columns. If the pressure is higher than a predetermined limit amount, then a message can be shown to the user to alert them they need to reduce the pressure first and then operate the lift columns.

Once the lift columns reach a zero baseline level, encoders (not shown) can be used to accurately tell the system the height of the lift columns. These encoders allow the system to know if one or more lift columns are significantly at a different height than any others and one or more lift columns may stop and wait for one or more other lift columns to catch up before one or more lift columns move again.

The Lift columns or vertical lifts 3296, 3298 can be built efficiently with certain features such as sliding rails and a cable channel. A smooth inner surface and rounded corners on the inner surface can protect the shell from abrasion as the lift column moves up and down during use. Channel blockades and a minimized channel gap can prevent or eliminate potentially pinch hazards. Putting the lifting carriage on the outside of the lifting column can also avoid abrasion of the enclosure 3210 and provide more width to the machine so that the angles of the ropes can at a desired angle β (FIG. 3), which can for example be about 45 degrees. However with the lifting carriages on the outside, if there is a gap with the lead screw, there is an increased chance of a pinch hazard and reducing this gap to less than, for example 8 mm, can enhance safety. A center guard can therefore be used where a section of the lift column protrudes through the lift column gap on either side, but the size of this protrusion can be less than about 8 mm without the gap creating a pinch hazard. These and related beneficial features have been included with example vertical lifts 3296 and 3298 along with other examples shown and described herein and along with related applications.

Further, drive motors have been incorporated with vertical lifts 3296 and 3298 that are unable to lift heavy loads, such as an inflated state during use of the DAP System 3240, which can help prevent crushing hazards. If a lift motor can likely stall when something is caught underneath (e.g., experiences a high load), then it can cause a current spike to the motor, but it will not injury a body that is inside and under the seal frame or other cause for the stall. The computer system 3300 including lift column system 3299 can also include a current monitoring step so that if it notices that the current is higher than a normal operating level, power is reduced or cut entirely to the motors. This safety monitoring step can be done in software, and/or can be done in hardware with a comparator type circuit. Monitoring of lift motor current can also be used to indicate to a user that the lift columns need maintenance. As lifts are used, the lubrication breaks down and periodically needs to be re-applied. As such, it may be important to monitor this current to be able to alert users, predict failures, and prevent system down time due to unexpected failures.

Figure 9C:
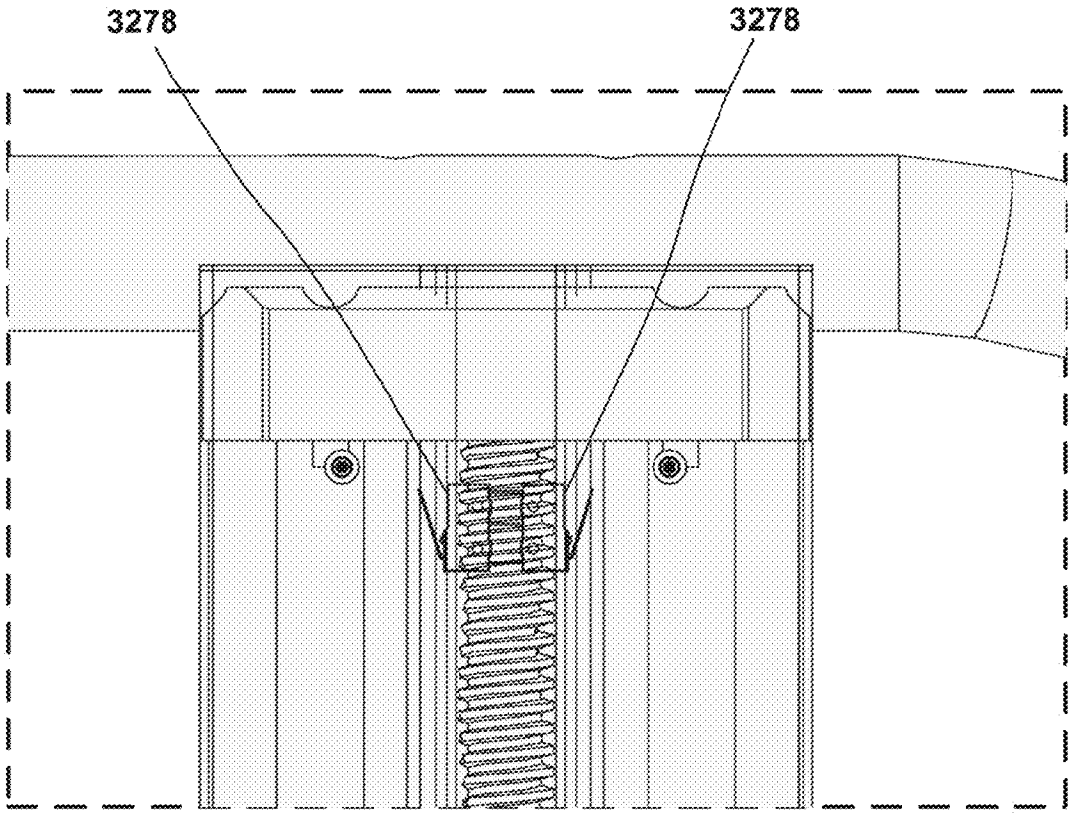

In one arrangement generally depicted along with FIGS. 9A to 9C, each lift column includes three, 3, limit switches 3278 and the motor has a two-channel incremental encoder. A first limit switch (not shown) can be located near a bottom portion of each lift 3296, 3298 that can be used to Zero the reading of the incremental encoder (not shown), which can be a software limit switch (not shown). Once the first limit switch (not shown) has been zeroed, the machine can calculate its lift column carriage height from the 0-point. The other two limit switches 3278 can include pairs of hardware switches located at upper and lower ends of each lift as shown in FIGS. 9B and 9C, which can cut the motor power if they are activated. Further, a safety feature can be built on the incremental encoder logic, so if the software fails and the motor runs to either very top or very bottom, it hits the hardware switches 3278 and the power can be cut. However, the computer system 3300 and lift system 3299 can be arranged so that the hardware switches 3278 are not activated during a normal operation of the machine, but are provided to act as secondary safety mechanisms.

The drive screw 3282 (FIG. 9B) can include use of a trapezoidal lead screw, which have flank angles and are arranged such that sliding friction prevents the nut or lead screw from moving without outside forces being applied or, in other words, is non-backdrivable. A non-backdrivable arrangement for the lead screw or drive screw 3282 and corresponding driven nut (not shown) provide vertical lifts 3296 and 3298 in which the lift mechanism and lift system 3299 are unable to move when the enclosure 3210 is fully pressurized for providing unweighting support during use of the DAP System 3240. In some arrangements, a trapezoidal lead screw 3282 can be used for vertical lifts 3296, 3298 having a diameter about 22 mm and a pitch of about 5 mm, which can also permit use of high-strength bearings based on a corresponding large diameter of such a lead screw arrangement. The trapezoidal lead screw 3282 can be formed from steel and the corresponding carrier or driven nut (not shown) attached to the carriage 3212 (FIG. 6) can be formed from gunmetal or red brass, which is a type of bronze or alloy of copper, tin and zinc that can provide benefits for usage with heavy loads and low speeds as generally encountered during operation of the vertical lifts 3296, 3298.

As can be seen in FIG. 9A, each vertical lift 3296, 3298 can include a motor mounted at a base portion and firmly retained with attachment of each vertical lift with the platform. The motors can spin quickly and drive a planetary gearbox during lift operations, which can create noise that can be amplified by metal structures. However, such noise and related sounds can be minimized via installation of each motor within a base portion of each lift that it is firmly secured to platform 3242 including rigid attachment to a lift bracket attached directly to the upper and lower covers as discussed in greater detail in applications filed herewith and dampened by the use of gaskets between attachment connections and adjacent structures and rubberized couplings (not shown) to decouple shaft vibrations from the screw and bearing attachments.

Example Rigid Seal Frame & Lift Connections; User-Releasable Couplings

Figure 2:
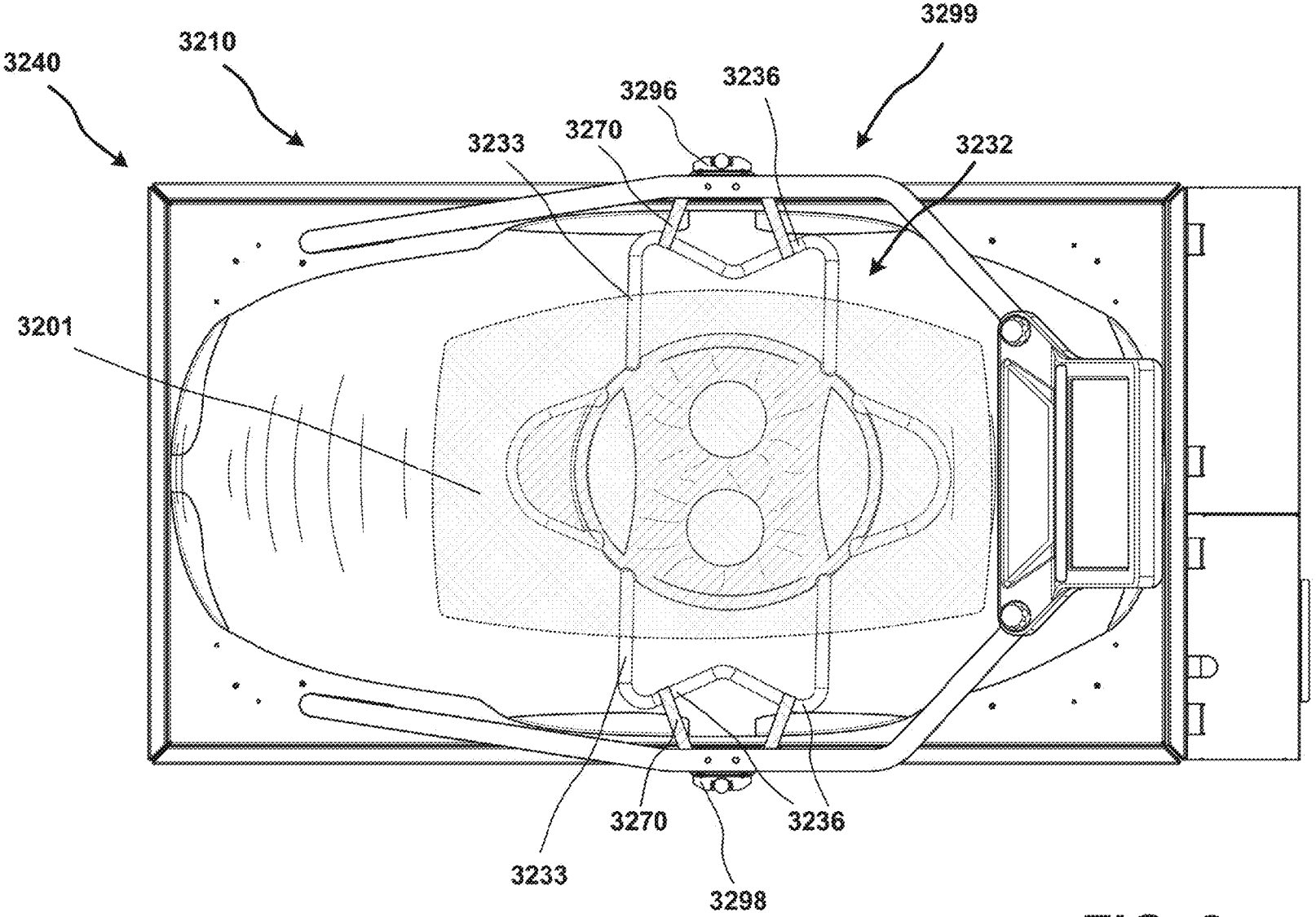
FIG. 2 is a top view of the DAP System of FIG. 1.

Referring now to FIGS. 10A to 10D along with FIGS. 6 and 7, a Lift Structure 3399 is generally shown for use a DAP System including with DAP System 3240 as an alternative lift structure for the lift structure of DAP System 3240 shown in FIGS. 1 to 3. The Lift Structure 3399 is shown apart from other components of the DAP System 3240 but can replace corresponding components of DAP System 3240 including Left Lift 3396 replacing Left Lift 3296, Right Lift 3398 replacing Right Lift 3396, and Seal Frame 3332 replacing Seal Frame 3232. Each of the Left and Right Lifts 3396, 3398 can be attached and integrated into the platform 3242 of DAP System 3240, and operatively connected to the DAP system control computer the same as for DAP System 3240. Each of Left and Right Lifts 3396, 3398 can include a corresponding carriage 3311 that is substantially the same as carriages 3211 for Left and Right Lifts 3296, 3298. As such, Lift Structure 3399 as incorporated with DAP System 3240 as replacement components generally includes the same aspects and features as DAP System 3240 except as discussed hereafter.

As shown, Seal Frame 3332 differs from seal frame 3232 in that the seal frame rigidly attaches with a corresponding carriage 3311 at opposite lateral end regions of the seal instead of via flexible restraints. Likewise, each carriage 3311 forms a rigid connection with the seal frame. Similar to the restraint pins 3276 (FIGS. 6 and 7) of DAP System 3240, which act as user-releasable coupling connectors 3276, user-releasable coupling connectors 3376 can releasably secure the rigid connections between each of the carriages 3311 and the seal frame 3332. As discussed further below along with FIGS. 11A and 11B, Lift Structure 3399 as installed on DAP System 3240 can provide a fixed connection DAP System that can generally operate substantially the same as DAP System 3240 including performing actions described along with FIGS. 11A and 11B as controlled by the DAP System computer control system 3300 (FIG. 4) except as described below.

Figure 10A:
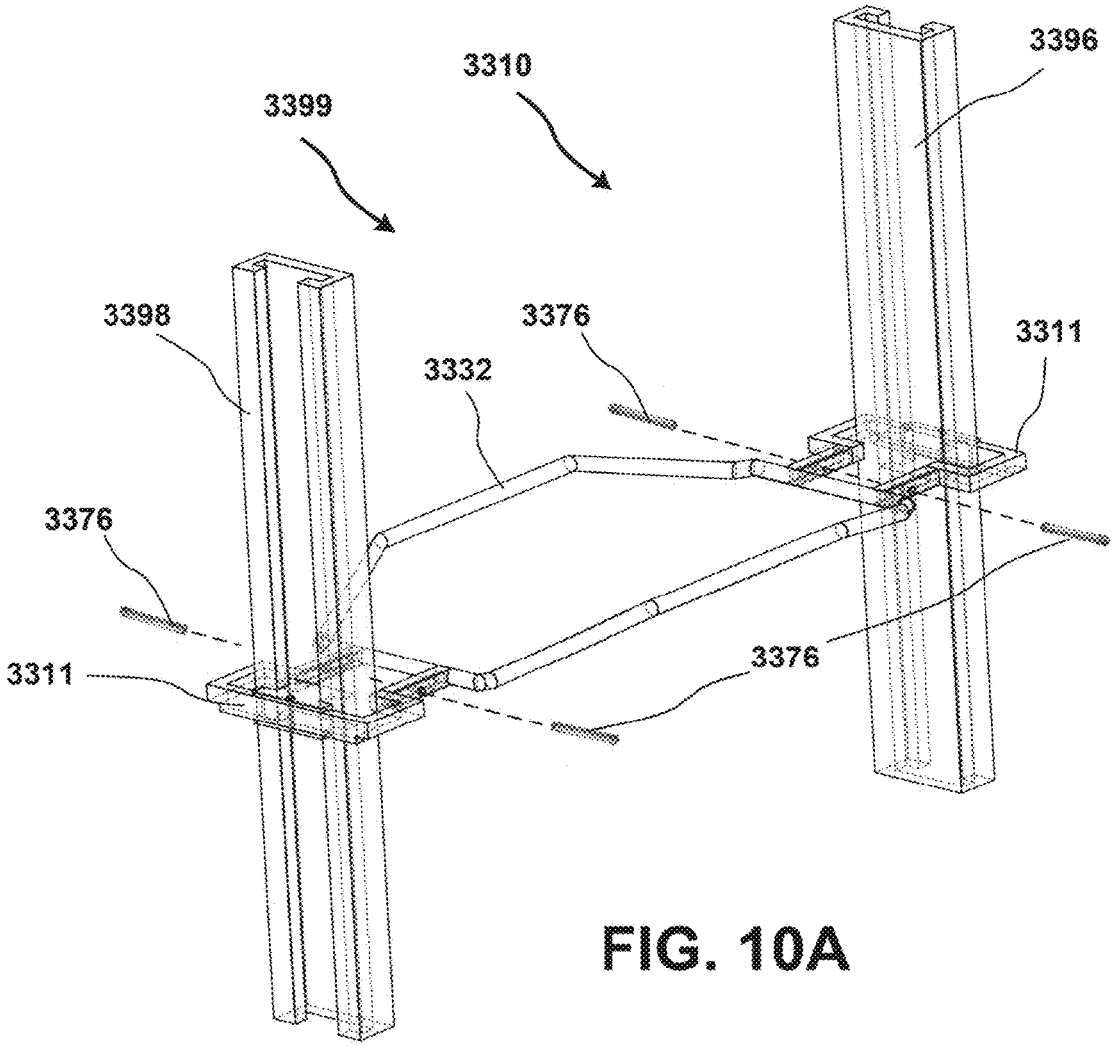
FIG. 10A is a perspective view of an example schematic representation of an alternative arrangement for lift components of a DAP System that includes a fixed connection arrangement between a pair of powered vertical lifts and a seal frame rigidly connected to a carriage of each lift.
Figure 10B:
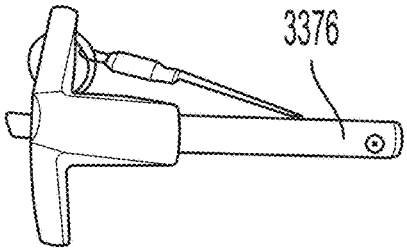
FIGS. 10B to 10D are plan views of example alternative user-releasable couplings that can be used with the arrangement of lift components of FIG. 10A.
Figure 10C:
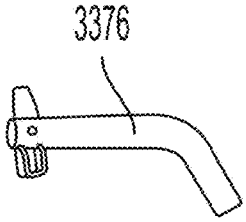
Figure 10D:
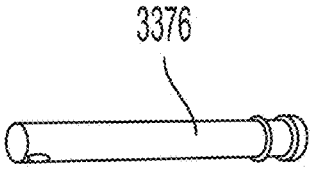

Further, the use of coupling connectors 3276 along with DAP System 3240 as shown in FIGS. 6 and 7 can enable quick release from the DAP System during urgent circumstances, such as loss of power, for allowing the user to detach the seal frame 3232 from the carriages 3211 for exiting the DAP System without the user climbing out of the seal frame when retained in a raised condition. Similarly, the user-releasable coupling connectors 3376 can also permit user exit from the DAP System for Lift Structure 3399 via release of the coupling connectors 3376. As shown in FIGS. 10B to 10C, a wide variety of fastener arrangements and types can be used for coupling connectors 3376 including, for example, extended length coupling connectors (not shown) such that a single coupling connector at each lateral side region of the seal frame 3332 can secure the rigid connection, as well as permit user release by removing fewer coupling connectors.

For each of the arrangements for DAP System 3240 including the flexible connection arrangement depicted in FIGS. 1 to 3 along with FIGS. 6 and 7, as well as when Lift Structure 3399 is combined with DAP System 3240, sensors (not shown) can be included in the structure. For instance, sensors can be included with carriages 3211 and 3311, such as proximity sensors or pressure switches within channels that secure the seal frame/carriage connections when each coupling connectors is installed and retained therein. The sensors can be operatively connected to the control computer 3000 and thereby signal presence and/or absence of each coupling connector for determining the installation status of each. As discussed further below along with FIGS. 11A and 11B regarding control actions for each of the fixed and flexible arrangements of DAP systems represented by DAP System 3240 and Lift Structure 3399, the control computer can readily detect when any of the coupling connectors are not present or have been released. Thus, the control computer 3000 can receive corresponding alerts and immediately perform one or more responsive actions based on detecting alert as described below, such as interrupting DAP operations.

Example Lift Method Actions

Figure 11A:
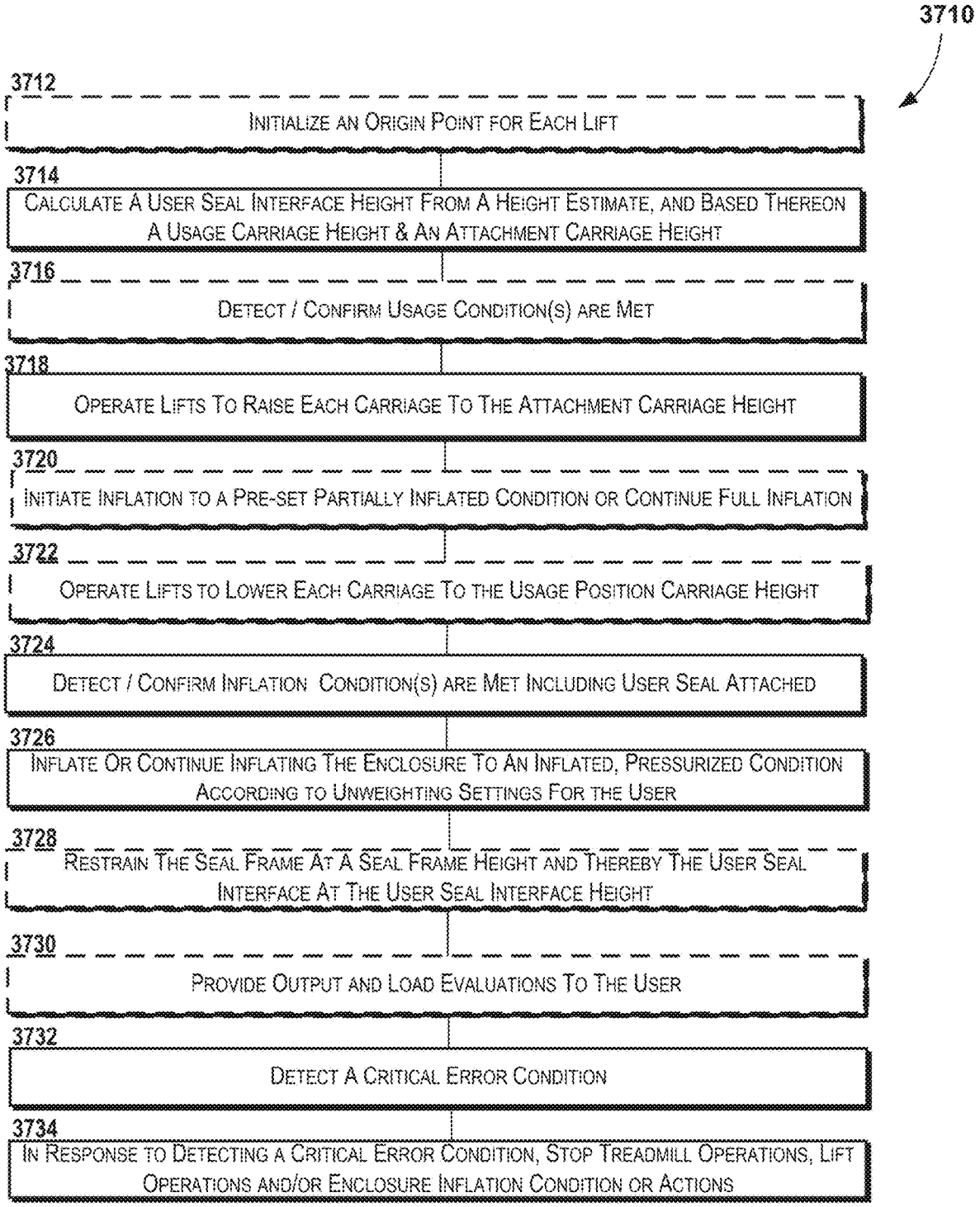
FIG. 11A schematically depicts steps of an example control method related to FIGS. 5 to 10 for operations of the DAP System of FIG. 1 for a user session.

Referring now to FIG. 11A, a method 3710 is generally shown for using a DAP system including, as an example for discussion purposes, DAP System 3240, as well as other DAP systems shown or described herein. The method can optionally include an action 3712 of initializing an origin point of each lift or, more precisely, initializing an origin point for the carriage of each lift with respect to the corresponding lift. The origin point can include one of a plurality of reference points along each lift from which a relative offset distance can be monitored for translation of the corresponding carriage during use. In some arrangements, an origin point can include a location along each lift against which the carriage height can be determined for lift operations, and can further include a location against which a DAP control system can be initialized for carriage height controls. A reference point can further include a location along each lift against which a carriage height determined based on an origin point can be evaluated for confirming the carriage height and evaluating accuracy of the determined carriage height. Further, a reference point can correspond with a sensor location along each lift placed proximate desired carriage travel positions, such as at or near a desired travel limit for the carriage of each lift, which can be useful for evaluating safe operations independent of height determinations or for performing safety actions independent of height determinations.

In some arrangements, the origin point for initialization actions can include a reference point at a base position of each lift along a lower region of each lift, which can be referred to as a zero point and considered as the origin from which positive offset carriage positions can be monitored. In other arrangements, the origin point for initialization actions can include a reference point at an elevated position of each lift, such as along an upper region or a middle region of each lift, which can be considered as the origin from which negative and/or positive offset carriage positions can be monitored.

Although Action 3712 for initializing an origin point for each lift is described herein as an initial action of method 3710, it is understood that no order for actions is described or implied for actions related to Method 3710 or for other methods described herein, nor that any action is required for to be performed for each use session of a DAP system. For example, the action of initializing the origin point for each lift can occur before, after or substantially concurrent with the action described below of detecting or confirming one or more usage conditions.

Returning to action 3712 and origin point initialization depicted in FIG. 11A, depending on the location of each carriage prior to initialization, initializing the zero point of each lift can include cycling each vertical lift 3296, 3298 through carriage movements described above for performing origin point initialization and/or positional verification as appropriate for accurately determining a vertical carriage position for each lift, by for example driving movement of the carriages up and/or down until a software limit switch or other sensor corresponding with a reference point is triggered. FIG. 5 depicts the lift carriages at an example base position, such as for user entry through the top opening of the enclosure, which can correspond with an origin location. The origin point can be vertically located at a position corresponding with user entry position or other base height, or can be vertically located at another position as desired, such as at a position corresponding with a lower limit of carriage heights for use of the DAP system.

The Action 3712 of initializing an origin point for each lift can optionally be included in Method 3710. In some arrangements, positional accuracy evaluations can routinely be performed during use of the DAP system, and the action 3712 of initializing an origin point for each lift can be performed when indicated by positional accuracy evaluations. In other arrangements, the action 3712 of initializing an origin point for each lift can be performed periodically at set intervals, according to particular actions like after maintenance actions or software updates, and/or prior to each usage of the DAP system.

Method 3710 can also include Action 3714 for determining a user seal interface height and thereby a usage carriage height for each lift, which can preferably be substantially the same for each lift, as well as an attachment carriage height. The attachment carriage height can include a height for each carriage to support the seal frame and the attached top portion of the enclosure proximate the top opening for enabling substantially unstressed attachment of the user seal interface with the top opening. The usage carriage height can include a height for each carriage during use of the DAP system in the inflated condition. The usage carriage height can be determined according to the seal frame interface height for the user. The seal frame interface height can include the height of the attachable/detachable connection of the user seal with the upper portion of the enclosure at the top opening. The seal frame interface height can be determined as: (i) An approximate best fit vertical position calculated based on user input; (ii) A previous setting for the user; and/or (iii) Based on supplemental inputs for determining such height as appropriate for the user.

For determination of the seal frame interface height as (i) an approximate best fit vertical position calculated based on user input, the user can enter information as one or more user inputs including a user height, a leg height and/or a hip height. Alternatively, height measurements viewable by the user can be placed along a vertical support for a handrail or along another vertical support, which can show heights above a top support surface of the DAP system against which a user can measure a hip or waist height for entry as a user input or for automated detection and entry based on user inputs. Automated detection and entry can include use of a camera or similar sensors like proximity detectors that can automatically detect the user's height based on interactive instructions and user entries for proceeding with the automated detection. Based on determining the user height, the user seal interface height can be determined according to a best fit determination for placement of the user seal at approximately 45-60% of the user's height, and more specifically about 55% of the user's height.

For determination of the seal frame interface height as (ii) a previous setting for the user, a preferred setting selected by the user via user input can be used the user's height and related settings and information including the usage carriage height. Alternatively, the user's height and related settings and information from a recent or immediately prior session can automatically be used as an option presented to the user for confirmation and/or as a default option based on presented to the user for confirmation. Further, based on user input identifying the user, prior session information including user height and carriage height can be presented for selection by the user or automatically provided as a default option subject to user confirmation. Such previous setting and related information can provide more accurate carriage heights for a desired seal frame interface height in accordance with user preferences and historical fine-tune height adjustments by the user.

For determination of the seal frame interface height as (iii) based on supplemental inputs for determining such height as appropriate for the user, a base height can be determined from a calculation based on a user input or from a previous setting for the user as discussed above along with (i) and (ii), which can be further modified based on a modification factor for the user like a temporary factor for modifying usage carriage height. The modification factor can accommodate a physical therapy factor input for the user, such as a user height increase factor for artificially increasing the user's height by a distance that can accommodate a therapeutic device attached to a leg of the user or for providing additional trunk support for users that have lower back issues or trunk instability.

The usage carriage height can be determined based on the determined user seal interface height via (i), (ii) or (iii), and both the usage carriage height and the attachment carriage height can be further determined according to factors specific for the corresponding DAP system arrangement. For (A) DAP system arrangements having a rigid connection between the seal frame and the carriage of each lift (see e.g., FIG. 10A), the usage carriage height can be substantially the same as a carriage height in the inflated condition that generally retains the seal frame and user seal interface around the user's iliac crest. Further, the usage carriage height can also be offset from the user seal interface height to accommodate for features of the seal frame and/or interfaces connections between the seal frame and carriages, such as a middle region of the seal frame connected to the top portion of the enclosure about the top opening being vertically offset from connections between the seal frame and each carriage. As such, for such system arrangements the attachment carriage can alternatively be higher than the usage carriage height to accommodate the offset distance and supporting the seal frame at an attachment height, which can higher than the usage carriage height by about twice the offset distance between the seal frame attachment and the top opening for enabling substantially stress-free attachment of the user seal to the enclosure at the top opening.

For (B) DAP system arrangements having a flexible connection between the seal frame and the carriage of each lift, such as via the use of flexible restraints (see e.g., FIG. 7), the attachment carriage height can be higher than the usage carriage height in the inflated condition to accommodate a flexible restraints distance and an offset height distance. In particular, for such system arrangements, the seal frame can hang down from the carriages supporting the seal frame according to a flexible restraints distance between connections of the flexible restraints on each side region of the seal frame to corresponding carriage while in the uninflated condition.

Further, the seal frame for such systems can also be attached to the enclosure about the top opening and proximate the top opening, which can be at an offset distance from the top opening. The seal frame attachment location proximate and offset from the top opening and user seal interface in the inflated condition forms a user seal boundary about the user seal interface that extends to the seal frame. However, for such attachment location and arrangement in the uninflated condition, the top opening hangs down from the seal frame based on an offset attachment distance between the seal frame and the enclosure. Thus, for (B) DAP systems having a flexible connection between the flexible restraints and the carriages, the attachment carriage height can accommodate a height for each carriage sufficient for vertically supporting the seal frame to hang downward according to the flexible restraints distance and for the enclosure top opening to hang downward according to the offset distance of the seal frame attachment with the enclosure. As such, the attachment carriage height can be higher than the usage carriage height by about twice the flexible restraints distance plus twice the offset distance for vertically supporting the enclosure top opening about the user at height for enabling unstressed attachment of the user seal interface with the enclosure at the top opening.

Thus, the usage carriage height can be calculated based on the determined seal frame interface height via (i), (ii) or (iii), as well as based on DAP system arrangement factors as appropriate, which can include compensating for an offset distance factor for either fixed or flexible restraint arrangements and, for flexible restraints arrangements compensating for the seal frame floating up during inflation to put the restraints in tension. Other DAP system arrangement factors can further be accommodated as appropriate, such seal frame shape and arrangement features like an offset height of a middle portion of the seal frame.

The method 3710 can further include the optional action 3716 of detecting or confirming one or more usage conditions are met prior to proceeding with other actions. As an example for DAP system arrangements that include a user-releasable coupling operatively connecting the seal frame to the movable carriage of a corresponding lift, the method can include detecting or confirming each user-releasable coupling is installed. Such detection or confirmation can include one or more sensors detecting or confirming installation of each user-releasable coupling, such as feedback from a proximity switch or from an engagement switch engaged by the coupling when properly installed. As another example, for DAP system arrangements that include one or more flexible restraints operatively connecting the seal frame to the movable carriage of a corresponding lift, the method can include detecting or confirming restraint attachments with both sides of the seal frame 3232. Detection or confirmation of usage conditions can further include detecting or confirming other example usage conditions, such as correct user positioning or presence through the top opening of the enclosure or on the exercise device, attachment of the user seal with the enclosure, and other conditions for safe and proper usage of the DAP system. The detection or confirmation action can include automated detection or feedback performed via computer system 3300, such as proximity sensors, vision systems and the like arranged for detecting restraint attachments and/or user positioning with respect to the seal frame and DAP System. Further, such an action can include manual response(s) or confirmation of restraint attachment, user positioning, and the like, as well as combinations of automated and manual detection and feedback.

Method 3710 can additionally include Action 3718 for raising left and right lifts to a user seal attachment position (see e.g., FIG. 7) for supporting the seal frame and thereby the top opening of the enclosure at a height for unstrssed user seal interface attachment to the flexible enclosure at the top opening and/or enabling user seal adjustments or other adjustments according to user preferences prior to inflation of the enclosure 3210. Such a height can be determined based on an attachment carriage height for the carriage of each lift as discussed above along with Action 3714. In general, the attachment position for the seal frame can be approximately around the user's iliac crest in order to make attachment to the user seal interface easier due the seal frame and the enclosure top opening being supported in a vertical position in proximity to the user's waist.

Method 3710 can optionally include the Action 3720 for initiating enclosure inflation, which can continue to a preset partially inflated condition of the enclosure or continue to inflate to the inflated condition depending on user completion of user seal interface attachment and/or other usage conditions. Inflation times can be sufficiently long compared with typical periods for user seal attachment and warrant initiating inflation of the enclosure at least to a partially inflated condition concurrent with other actions, such as concurrent with user seal interface attachment. As such, the DAP system can be configured to initiate inflation substantially concurrent with Action 3718 for raising each carriage to the user seal attachment position along with stopping inflation when a pre-set partially inflated condition is met, or continuing inflation to the full inflation condition if attachment of the user seal or other conditions have been confirmed prior to reaching the pre-set partially inflated condition.

Method 3710 can continue with optional Action 3722 for lowering left and right lifts to a usage position which can position each carriage at a usage carriage height for the inflated condition during use of the DAP system (see e.g., FIG. 6). While in the uninflated state prior to inflation with each carriage at the usage carriage height, as discussed above along with Action 3714, the top opening/user seal interface location and/or the seal frame can hang down from each carriage as can be seen in FIG. 6 for a flexible connections arrangement. However, when the enclosure is inflated and during inflation, the flexible enclosure, the top opening, the user seal interface, and optionally the seal frame are configured to float vertically upwards according to offset distance connections between the seal frame and the user seal interface and/or seal frame shape or other system specific factors, and for flexible connection arrangements until the flexible restraints restrict vertical movement of the seal frame according to the usage carriage heights and thereby restrain the user seal interface at a position roughly at the user's iliac crest (see e.g., FIG. 8).

Method 3710 can further include an Action 3724 for confirming user seal attachment with the enclosure, which can occur via user input or automatic detection as described above along with Action 3716. Further, optional Action 3716 can be performed as part of Action 3724, such that inflation conditions including user seal interface attachment are confirmed concurrent with confirmation of usage conditions.

Figure 8:
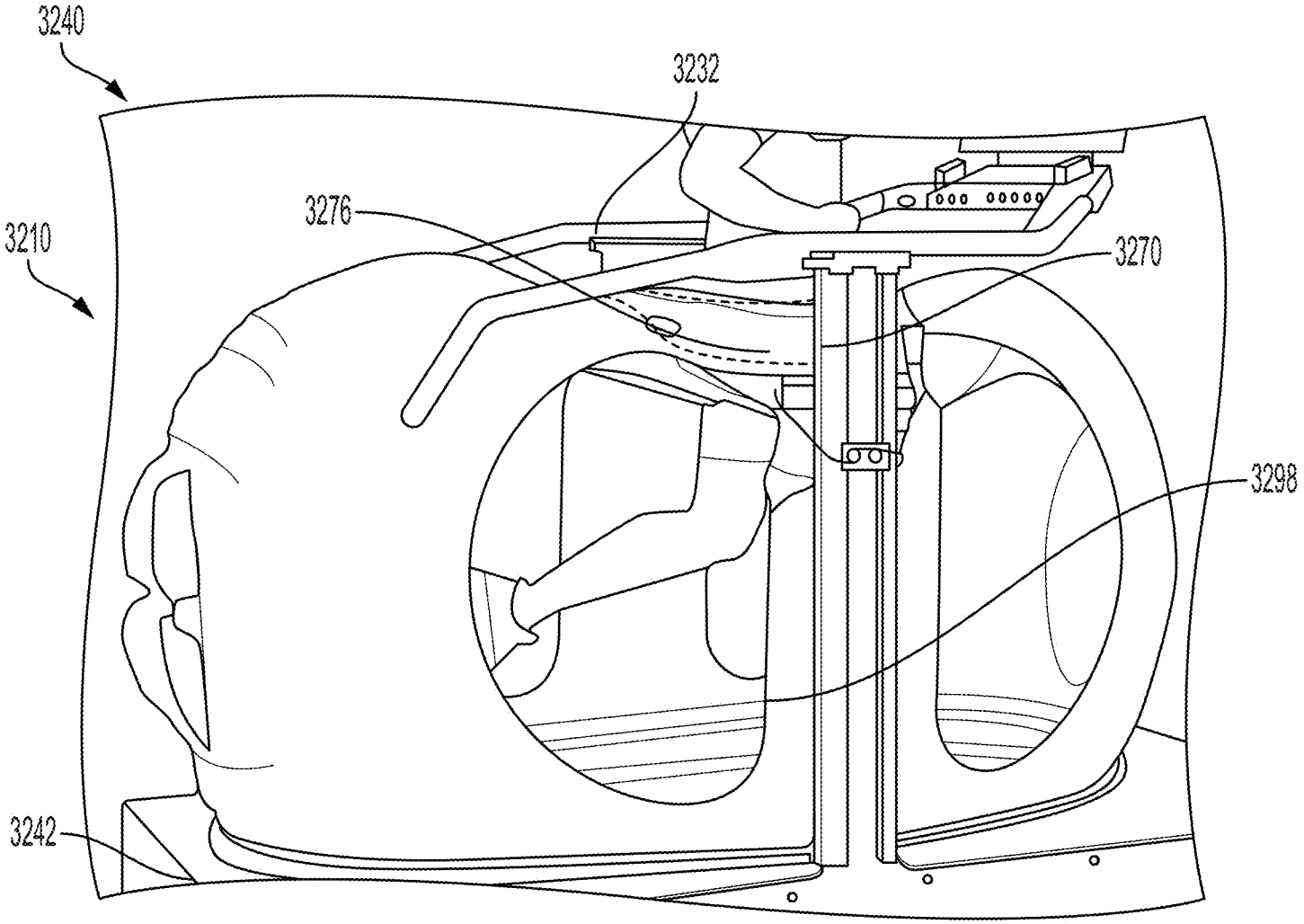
FIG. 8 is a right side perspective view of the example schematic representation of a DAP System of FIG. 1 shown in a fully inflated, hybrid framework arrangement without an example user located therein.

Method 3710 can also include Action 3728 for restraining the seal frame at a seal frame height and thereby restrain the user seal interface at the user seal interface. For flexible connection DAP System arrangements described herein, the flexible tensile restraints are attached to each carriage at a corresponding carriage connector and at an opposite end to a corresponding restraint connector of the seal frame. As can be seen in FIG. 8 and described herein, the flexible tensile restraints restrain portions on the seal frame disposed about the user seal interface at a seal frame height based on attachment of the flexible restraints to the corresponding carriage. The seal frame further restrains the user seal interface at the user seal interface height via the user seal boundary region of the enclosure top portion that extends between the user seal interface and the seal frame.

Method 3710 can optionally include Action 3730 for providing output and load evaluations to the user, which is described in greater detail below in the following section entitled "Output and Cumulative Load Evaluations." Method 3710 can further include Action 3732 for detecting a critical error condition, and Action 3734 for, in response to detecting a critical error condition, stopping treadmill operations, lift operations and and/or enclosure inflation condition or inflation actions. The safety Actions 3732 and 3734 include various safety monitoring and response actions described herein including example safety actions described in greater detail below along with FIG. 11B and Method 3750.

When finishing a workout, the DAP system can be deflated and a user can manually lower the lift including pushing a button or selecting an option to lower the lift automatically. An optional Action (not shown) can stop the lift when moving vertically downward or when moving vertically downward after reaching a minimum safety height, which can prevent accidental compression of a potential obstruction, i.e., a body or portion thereof underneath. A user can be prompted to confirm further downward movement of the seal frame upon reaching the minimum safety height, and then Method 3710 can be repeated for a subsequent user. While any of Actions 3712 to 3728 are being performed, subsystem background safety monitoring can be performed as described herein even though such actions are not shown or referred to in detail in FIG. 11A.

Example Method For In-Use, Inflated, Height Adjustments and System Monitoring

Figure 11B:
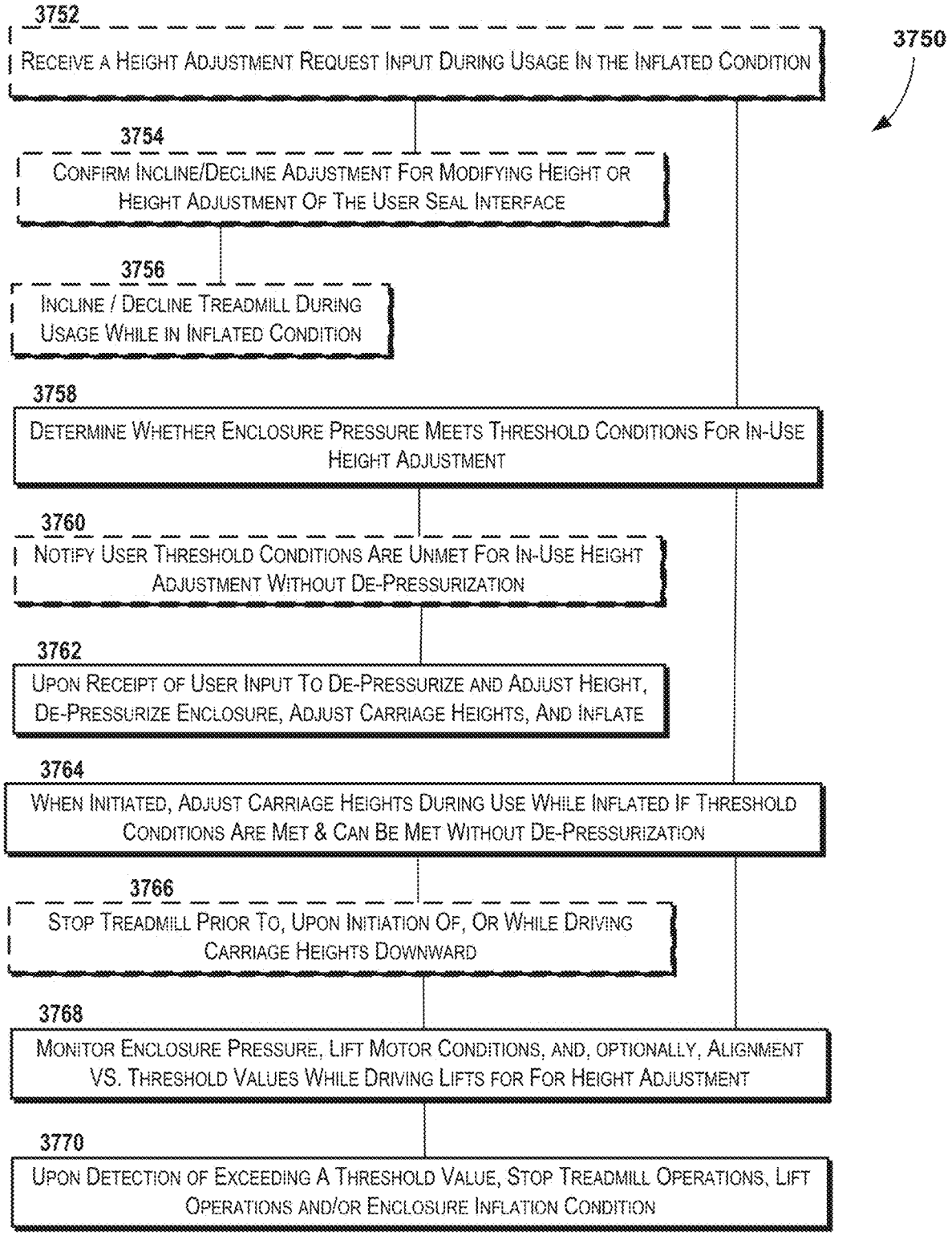
FIG. 11B schematically depicts steps of an example operational control method related to FIGS. 5 to 10 for in-use, inflated operations of the DAP System of FIG. 1 for a user session.

Referring now to FIG. 11B, a Method 3750 is generally shown for adjusting height of a user seal interface and thereby height of the DAP system user during use of the DAP system for an exercise or training session. In other words, Actions of Method 3750 occur or, more precisely, are performed or executed by the DAP control system while in use for a user session, such that the inflatable enclosure is pressurized and the lifts are in usage positions with each carriage at a usage carriage height as described above along with Method 3710. As with Method 3710 discussed above, Method 3750 can be performed with DAP system 3240 described above, with other DAP systems described herein and in related applications identified at the beginning of this specification and incorporated herein by reference, and with other DAP systems having height adjustment features including conventional DAP systems. Further, Method 3750 and various Actions described as part of Method 3750 can be performed as part of Method 3710, such as Action 3768 occurring as part of Action 3734 described above for Method 3710. Further, the Actions of Method 3750 can be included as additional Actions of Method 3710 as part of an overall method for controlling a height adjustable DAP system. In addition, individual actions or combinations of actions of Method 3750 can be considered as an independent method or methods based on combinations of actions described herein, which can be performed independently of Method 3710, such as for a height-adjustable DAP system that requires attachment of the user seal interface prior to raising any lifts and fails to perform the action of raising a pair of lifts to a user-seal attachment position. As for Method 3710, no order is implied or required for the Actions of Method 3750 except as specifically described for an Action.

Method 3750 includes an optional Action 3752 of receiving a height adjustment request input from the user of a DAP system during usage in the inflated condition. Action 3752 can be optional with respect to initiating a height adjustment or, in general, for creating conditions pertaining to other actions of Method 3750 for detecting and performing safety actions. Action 3712 provides an optional action that can provide circumstances for initiating actions that can occur during usage of the DAP system and, in particular, pertaining to adjustments or changes occurring that involve vertical lift movements including driving respective carriages up or down, and changing enclosure pressure including increasing or decreasing pressure. Circumstances for such actions can be initiated, triggered or set in motion based on various other actions including, for instance, automatic fine tune adjustments or as part of an exercise or therapy routine or session. For example, blood flow restriction training systems, devices and methods are described below that can be incorporated into DAP system 3240 including control devices for the BFR system operatively communicating with the DAP system computer 3000, which for various implementations and related aspects and features described below for BFR treatment, can include lift actions, pressurization/depressurization actions, and height adjustment actions occurring as automated actions or as part of a treatment routine without requiring a user input adjustment request.

Method 3750 can further include optional Action 3754 for confirming height adjustment actions include height adjustment of the user seal interface, inclining or declining an incline of the exercise device such as a treadmill incline or decline, and/or both. Fine tuning adjustments pertaining to height and a user's comfort regarding height can involve adjusting the user seal height with respect to an exercise device engagement surface, as well as adjusting an incline or decline of the exercise device engagement surface instead of height adjustment to provide similar effects, such as a treadmill incline or decline. In many instances, fine tune height adjustments can be met via incline/decline adjustments alone and/or incline/decline adjustments in combination with height adjustments. Further, as discussed below pertaining to blood flow restriction training incorporated into or used with the DAP system, both enclosure pressure and exercise device incline/decline settings can be adjusted as part of blood flow restriction training with respect to intensity factors, such as changing either or both settings in response to or concurrent with changes for blood flow restrictions. Accordingly, Action 3754 can optionally occur as a request for user confirmation or clarification regarding height adjustments involving user seal interface height changes, exercise device changes, or a combination of related settings. Further, Action 3754 can optionally provide suggestions to the user for alternative modifications for height adjustment, intensity setting or other related settings that can include notification of impending adjustment actions and user confirmation of the same prior to performing the actions including incline/decline adjustments or height adjustments. Thus, Action 3754 can occur independent of Action 3752 and/or responsive a user height adjustment request.

Method 3750 also includes optional Action 3756 for controlling the DAP system 3240 for adjusting exercise device incline/decline settings including treadmill incline/decline settings during use of the DAP system while in the inflated condition. Action 3756 can occur alone, such as for fine tuning height related settings via incline/decline setting alone without lift actions or enclosure pressure changes. Further, Action 3756 can occur in combination with other adjustments including lift and inflation adjustments, and can occur prior to, during, or simultaneously with other adjustments.

Method 3750 can additionally include Action 3758 for determining whether enclosure pressure meets threshold conditions for in-use height adjustment. As discussed above along with Action 3752, various actions and circumstances occurring during use of the DAP system while in the inflated condition can trigger, initiate, cause or routinely implicate DAP control system actions pertaining to height adjustment, which may or may not relate to user inputs beyond inputs for initiating use of the DAP system. That said, whether in response to user inputs, actions for executing a training plan, actions related to other activity or factors can include for instance, BFR activities, or for other reasons can include periodic safety monitoring actions and determinations occurring during typical use of the DAP system, for which the DAP control system can perform Action 3758 for determining whether enclosure pressure meets threshold conditions for in-use height adjustment.

Additionally, Method 3750 can include Action 3760 for notifying the user that threshold conditions are unmet without depressurization. Further to discussions above along with Action 3752 and Action 3758, Action 3760 can occur, be initiated or triggered, and/or be executed by the DAP control system in response to or based on many different circumstances and usage situations, which can be independent of a user input or a user request. For example, a flashing light, screen icon or indicator, or other indication can continually notify a user whether threshold conditions are currently met or unmet for in-use height adjustment without depressurization.

Further, Method 3750 can include Action 3762 for depressurizing, adjusting usage carriage heights, and inflating to usage pressure settings, in response to or upon receipt of user input to depressurize and adjust height. Action 3762 can be a conditional action that can occur or not occur, or rather be executed by the DAP system or not executed, based on, in response to, or upon receipt of a user input for depressurizing, adjusting height, which may or may not be related to actions 3752 to 3760. For example, a 'Pause' option allowing the user to exit the DAP system for a short break can be provided, which when selected by the user can include a request to de-pressurize and adjust height downward so as to permit the user to exit the system for the break. Upon return and reconnection to the DAP system, the user can un-pause and the DAP system can be followed by the DAP system inflating as part of resuming the user session.

In addition, Action 3762 can occur responsive to an explicit user input requesting height adjustment along with de-pressurization, such as receiving a user request to reset the user seal interface height based on an amended estimate for the user height and to reset the unweighting percentage to a different setting. Further, Action 3762 can occur via user interactions with the DAP control system that include optional Actions 3752 and 3760, such that Action 3762 occurs as a result of a user height adjustment request, for which the user receives notification via Action 3760 that the DAP system is unable to adjust height without de-pressurization, and thereafter provides input for requesting depressurization and height adjustment.

Method 3750 can further include the Action 3764 of when initiated, adjusting carriage heights during use while inflated if threshold conditions are met without requiring depressurization. Action 3764 is a conditional action that can occur or not occur based upon an initiation request or event occurring, and further conditional on whether threshold conditions are met and can be met without depressurization. As such, in addition to performing an action such as Action 3758 for determining whether pressure meets threshold conditions, the DAP system can determine whether pressure threshold conditions can be met during adjustment actions, as well as whether other threshold conditions can be met, such as lift motor conditions and optionally alignment conditions. The condition "when initiated" can include various actions, inputs or triggers for initiating in-use, pressurized, height adjustment, which can include and be responsive to Action 3752 for receiving a height adjustment request input from the user during usage in the inflated condition. Further, such an adjustment can be initiated as part of a workout routine or treatment plan, such as a routine or plan involving BFR treatment concurrent with unweighted exercise. If threshold conditions are met and can be met for the initiated adjustment without depressurization, the DAP control system can proceed to drive adjustment of the carriage heights during use while inflated from a first user seal interface height to a second user seal interface height different from the first.

Further, Method 3750 can include the optional Action 3766 of stopping the exercise device, such as a treadmill, prior to or upon initiation of driving carriage heights downward, which can occur along with or part of Action 3764 for in-use, inflated, height adjustments that are initiated for lowering the usage carriage height and user seal interface height. The DAP system can further perform Action 3766 independent from and without performing in-use, inflated, height adjustments. For example, Action 3766 can occur as part of shut down operations at the end of a user's setting, for which the DAP system can act to stop the exercise device, such as a treadmill, prior to or upon initiation of driving carriage heights downward. Action 3766 can be performed as an optional safety action for ensuring no user limbs or other body parts are located below the seal frame or other moving parts when lowering, and for reducing user movement and the likelihood of losing balance while moving with the exercise device during lowering operations. In some implementations, Acton 3766 can be conditioned on a low height setting, such as stopping the exercise device while driving the carriage heights downward when the carriage heights are at or below a predetermined setting.

Method 3750 can further include the optional Action 3768 of monitoring various system conditions pertaining to height adjustment operations during such operations, which can further occur at other times during system use, such as prior to performing height adjustment operations as discussed above along with Action 3758, and/or on a periodic or continual basis as part of overall safety features and system controls. Such operations can be more closely or frequently monitored during height adjustment operations including, in particular, enclosure pressure and lift motor conditions, such as motor current and optionally carriage alignment during vertical moves. As such, the DAP system monitor motor current and enclosure pressure during height adjustments, such that if a lift motor current exceeds a threshold limit and/or an enclosure pressure reading exceeds a threshold pressure or encounters rapid changes, safety or preventative actions can immediately occur for avoiding injury or system damage.

Optionally, carriage alignments can further be monitored during adjustments for ensuring any offset between carriage heights while being vertically driven is within a threshold offset range for avoiding racking between the lifts, as well as for indicating other problems or concerns, such as encountering a blockage or obstruction or a failure or operational concern for one of the lifts. Flexible connection systems for connections, such as those having flexible restraint connections between the seal frame and lifts as discussed above, can enable significant ranges of independent vertical movement without risk of racking and related concerns. As such, alignment conditions can be less likely to occur and can be monitored as an optional features and/or be monitored less frequently during operations. However, for fixed connection arrangements between the seal frame and corresponding carriages, issues and concerns can arise more easily, such as racking between the lifts occurring for relatively small offsets between carriage heights. Thus, various conditions including alignment can be monitored or optionally monitored during adjustment operations and/or during system use based on aspects and features of the specific DAP system in accordance with potential risks and likelihood of issues or concerns arising for the DAP system arrangement.

Method 3750 can include a responsive Action 3770 for taking immediate preventative or corrective action upon detecting one or more conditions exceeds a corresponding threshold limit. In the case of safety conditions related to system use in general, such as monitoring the installation status of user-removable couplings between seal from and carriage connections, immediate default safety actions can occur at any time upon detection of a limit or threshold being exceeded like detecting removal of a user-removable coupling. Action 3770 can include taking immediate preventative or corrective action based on the condition detected and corresponding immediate actions for the detected failure condition. In the case of failure or exceeding a threshold condition for various safety concerns, Action 3770 can include immediate shutdown actions including stopping operation of the exercise device, such as stopping treadmill operations, as well as stopping lift adjustment operations if underway and/or depressurization and deflation of the enclosure.

Further, Action 3770 can include immediately performing other actions for addressing a likely cause of the failure condition and mitigating potential injury or damages without ceasing system operations or shutting the system down. For example, during height adjustments, if the lift is moving down, the lift can stop or otherwise reverse a set distance to remove a detected obstruction, or if the lift is moving up, the DAP system computer can slow down the speed of carriage movements to reduce motor current and come to a stop if current remains over a limit. Further, the control system can block or interrupt lift functions if the enclosure pressure exceeds a limit threshold, such as for example >3 mmHg. While lowering, the system can monitor motor current for each lift, and if sensing a current above the limit, move the lifts in reverse, upwards on the lift column, to avoid potentially hitting the user or someone else around the machine. When resuming from an interim paused state, the system can optionally restore the lift position to its previous location before allowing pressurization of the system, and can optionally prompt the user to allow each action. When terminating the workout, the user can manually lower the system or may be prompted for user input, for example pushing a button, which can automatically lower the lifts. In lowering to the base position of FIG. 5, the lifts can optionally stop at a pre-determined distance above the bottom and require confirmation that there are no obstructions in order to proceed.

Finally, in regard to Methods 3710 and 3750, it is understood that while it may be advantageous to include certain steps described, it may not be necessary for proper and safe function of the lift system. For example, steps that involve checking for user input can be automatically started without user input. As another example, while Action 3718 of Method 3710 for operating the lifts to raise each carriage to the attachment carriage height can be convenient for supporting user to seal frame attachment, it can also be skipped entirely and the lifts could be operated along with Action 3722 of Method 3710 for operating the lifts to move to the usage position carriage height, such that seal frame and user seal interface floats into the user seal interface position roughly at 55% of the user's height. Skipping Action 3718 for instance can be appropriate for resuming operations after an interruption while the user seal remains attached to the enclosure. Thus, although various actions are described generally as actions included for Method 3710 or 3750 while others are described as optional, it is understood that the various actions can be executed, skipped, optionally performed or not, and otherwise performed or skipped as necessary and proper control decisions by the DAP control system.

Output and Cumulative Load Evaluations

Conventional treadmills and other traditional, unweighting, exercise equipment can show a "watts" or "output" measurement indicating an exercise output for an exercise session. On exercise bicycles, these are taken by looking at resistance and cadence. On treadmills or for running exercises, such values are determined based on factors such as running speed and incline. DAP Systems as described herein and for related patent applications can evaluate additional factors pertaining to applied unweighting that can be beneficial for the user, such as an added factor for a change in body weight based on unweighting, lift type forces provided for the user. For instance, DAP Systems described herein and related control computer systems can evaluate output for a user running session based, for instance, on (speed×% gradex% bodyweight). In a particular example in which the user's weight can be reduced by 16% due to unweighting benefits applied, a session output could be evaluated more accurately based, for instance, on (speed×% grade)×(% bodyweight×0.84). Such a determined output could be provided to the user as an output value in watts or calories burned.

As a particular implementation example, exercise session output can be calculated by the DAP System and output information can be provided to the user based on the following relationships:

AVERAGE OUTPUT (mL oxygen per min per kg)= $(1-((-0.1302*\%\ BW)+1.2045))*(3.5+(0.2*v)+0.9*v*G))/3.5$ as volume of oxygen expended by the user per min, and per kg, mass, which can be converted to average calories in kcal/min.

TOTAL CALORIES=average calories*workout duration in minutes, where

% BW=body weight % (in decimal form);

v=velocity in meters/min; and

G=% gradient (in decimal form); such that

AVERAGE POWER (Watts)=average calories*69.5; and

TOTAL WORK (kJ)=(average power*workout duration in seconds)/1000.

Further aspects, features and benefits related to controls and evaluation of exercise sessions for DAP Systems described herein and with related applications can include cumulative load evaluations, as well as saved cumulative load regarding reduction in cumulative load enabled for a user based on unweighting benefits. For instance, if a user weighing 200 lbs runs at an average pace of eight (8) miles per hour for a full hour, an estimate of cumulative load could be determined for exercising with DAP System unweighting benefits, as well as a comparative load without unweighting benefits and providing comparative information for cumulative load savings. Such an estimate pertaining to load determinations can be based on ground reaction forces for the person of a given weight (e.g., 200 lbs) while running at a specific speed (e.g., eight miles per hour) for a particular period (e.g., one hour). Assuming for discussion purposes, a cumulative load for the person running during an exercise session without DAP System assistance is about 20,000 lbs for the workout. Assume further as a comparison that the same person uses a DAP System described herein for the exercise session, but instead of running at full body weight the user runs for 30 min at 80% bodyweight and 30 min at 70% bodyweight. DAP Systems and corresponding computer controls described herein can be arranged for determining an actual cumulative load for the user and session in view of unweighting benefits encountered, which for instance could determine the user encountered 16,000 lbs of cumulative load for the session instead of the fully 20,000 cumulative load, in which their body saved or avoided impacts for 4,000 lbs of load vs. similar exercise without gained benefits from the DAP System.

BFR Example

Unweighting exercise routines can provide a wide range of benefits and advantages—particularly for cases and circumstances involving injuries, rehabilitation, and the like. However, unweighted exercise routines can also involve reduced overall work and effort, and thereby reduced training effect. Removing weight, load and related exercise resistance can correspondingly reduce muscle development effects of exercise routines. A novel approach to building muscle without load or with minimal loading can include reducing blood flow to working muscles that are exercising as a way to accelerate metabolic stress and produce an anabolic physiologic response, which in combination with unweighting exercise can mitigate potential losses related to unweighted exercise and/or improve its effectiveness. Blood Flow Restriction (BFR) or occlusion training involves disrupting blood flow to limbs at work via a tourniquet or tight cuff placed around the limb, in which pressure can be increased and released along with training. The band or cuff applies compression on the limb, which restricts blood flow into the limb (carries oxygen) and out of the limb (carries lactic acid and other muscle activity waste) below the level of compression. This creates a low oxygen, increased lactic acid environment for limb muscles, which forces the muscles to work harder and increase protein synthesis that is important for both muscle repair and growth. Professional and Olympic athletes have long benefited from the use of BFR training. However, low load occlusion training and low-intensity occlusion aerobic training are proven beneficial tools for musculoskeletal rehabilitation and for injury recovery, as well as for treating chronic conditions along with no load or low load training. As such, BFR training can integrate well with reduced load, unweighting exercise of DAP systems.

In some cases it may be advantageous to cycle the blood flow restriction by increasing and decreasing the amount of air volume in the bands, and thus the applied compression, at a pre-determined rate. This can even be done without the treadmill operating. Alternatively, a pattern can be maintained where during periods of slower, easier exercise the pressure in the bands is increased in order to accelerate the buildup of lactic acid and metabolites, and when more vigorous exercise is started, the air volume is decreased to promote comfort associated with the lower compression levels. This can alternatively be reversed where periods of more vigorous activity are accompanied by high air volumes in the bands and applied compression, and periods of less vigorous exercise have lower air volumes and less applied compression. This can help maintain a more even buildup of metabolites where a larger amount of compression is needed to combat a strong muscle pump from the vigorous exercise and a lower amount of compression is needed when less vigorous exercise is performed which has a softer muscle pump.

Figure 12:
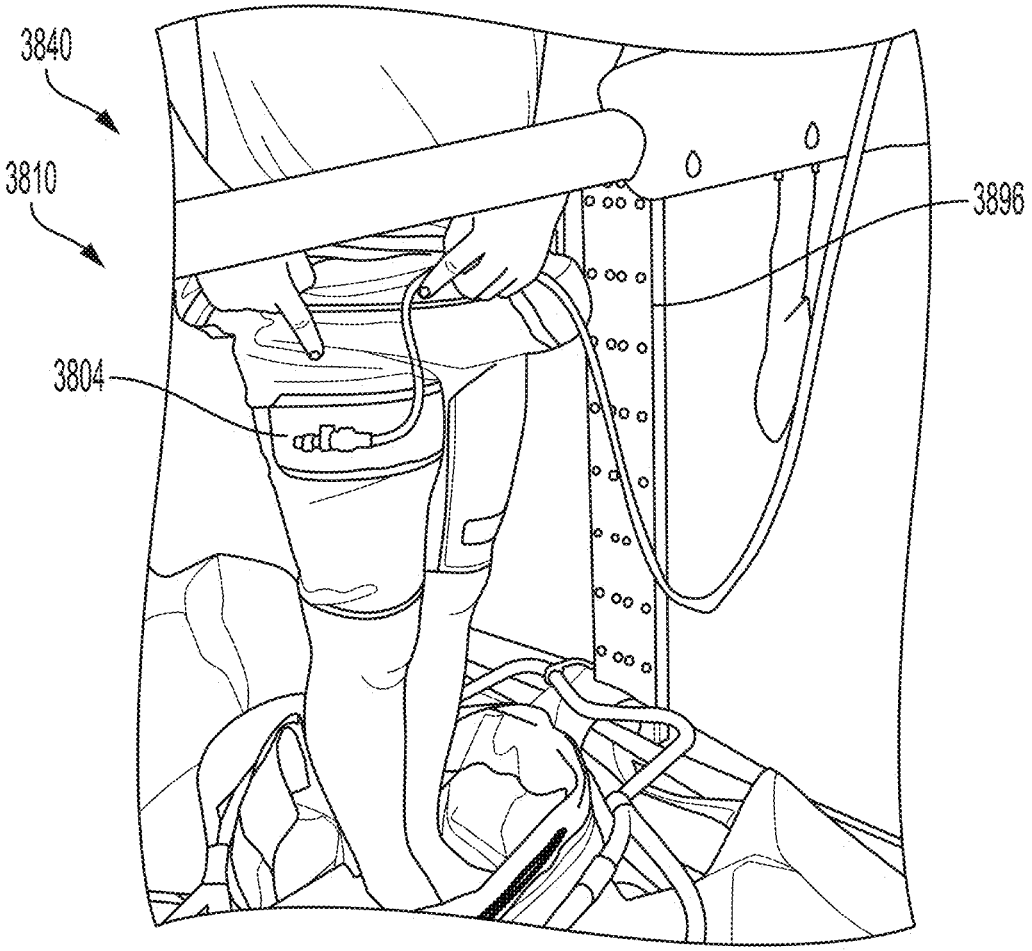
FIG. 12 is a front perspective view of an example user of the DAP System of FIG. 1 along with user worn controls for a supplemental Blood Flow Restriction (BFR) System and related exercise methods according to aspects, features and exercise concepts described herein, which can be used with DAP Systems described herein including the DAP System of FIG. 1 as depicted with related Figures herein.
Figure 13:
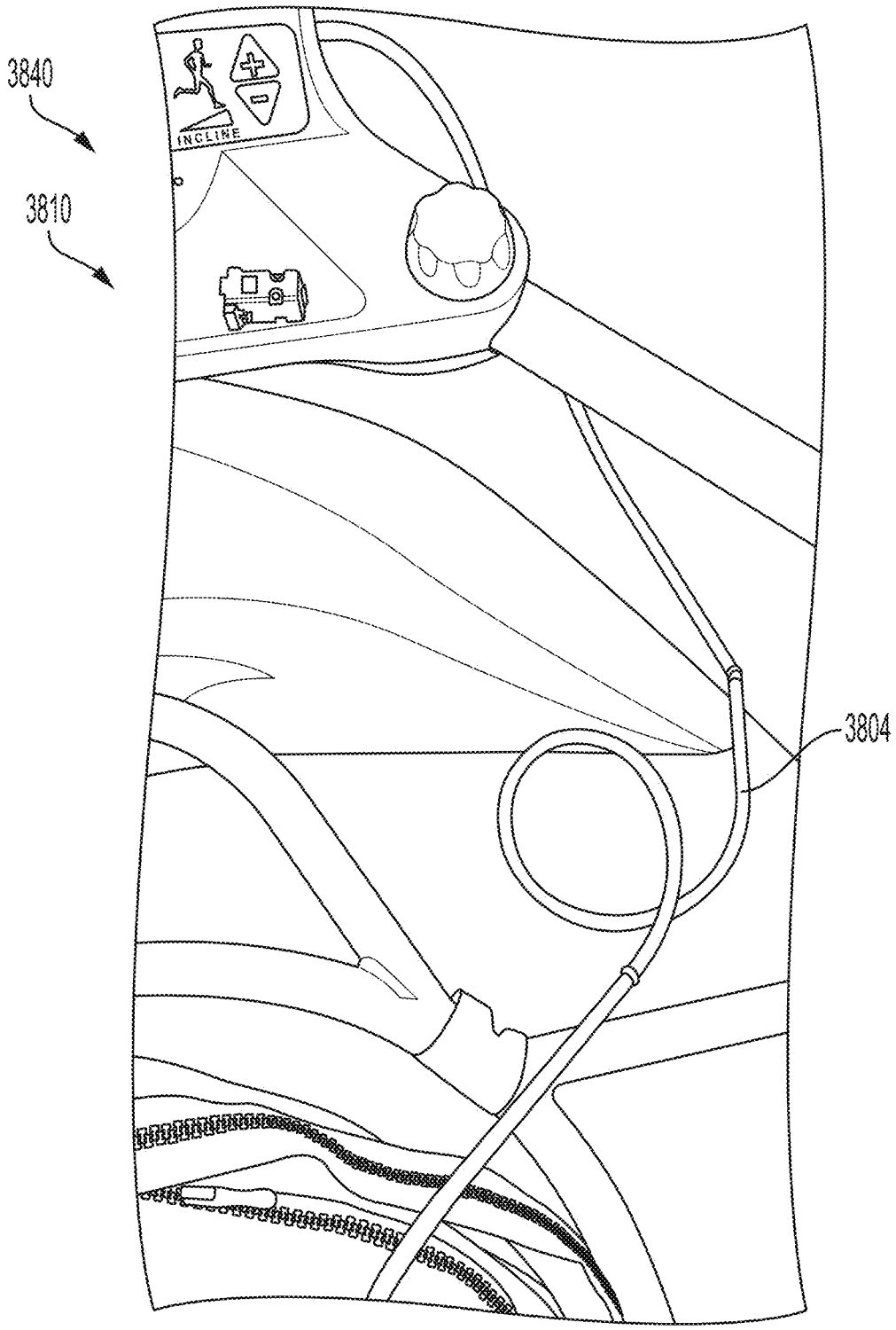
FIG. 13 is a top perspective view of an example BFR connector for the BFR System and method of FIG. 12.

Referring now to FIGS. 12 and 13, blood flow training generally involves the placement of bands that can selectively pressurized around the arms and legs for applying a range of compression to the limb for partially restricting (occluding) blood flow during exercise including arterial blood flow into the limb and venous blood flow out of the limb at pressures below the applied level of compression. These bands can be pneumatic for which pneumatic pressure in the bands can be selectively applied and adjusted for controlling compression exerted by the bands, or in some cases can just be cinchable straps. Further, in some arrangements, the bands can be pressurized via pressurized liquid provided to bands and/or include a liquid filled cavity along with a pneumatic chamber. The strapping or inflatable bands 3804 can be separately attached to or placed around a garment 3805 that is used to attach the user to the unweighting treadmill, or can be placed on the limb separate from the attachment garment. In either case, the unweighting treadmill may include instructions to the user for cinching the straps to a setting stored in memory in the unweighting machine or may automate this process with an electric motor pulling air into the strap to make the strap tighter by the right amount combined with one or more controllable release valves and pressure sensors, and/or a source of compressed air combined with controllable supply and release valves and pressure sensors. The DAP system can supply and release pneumatic pressure to the strap or band for applying a determined compression about the user's limb.

Figure 14:
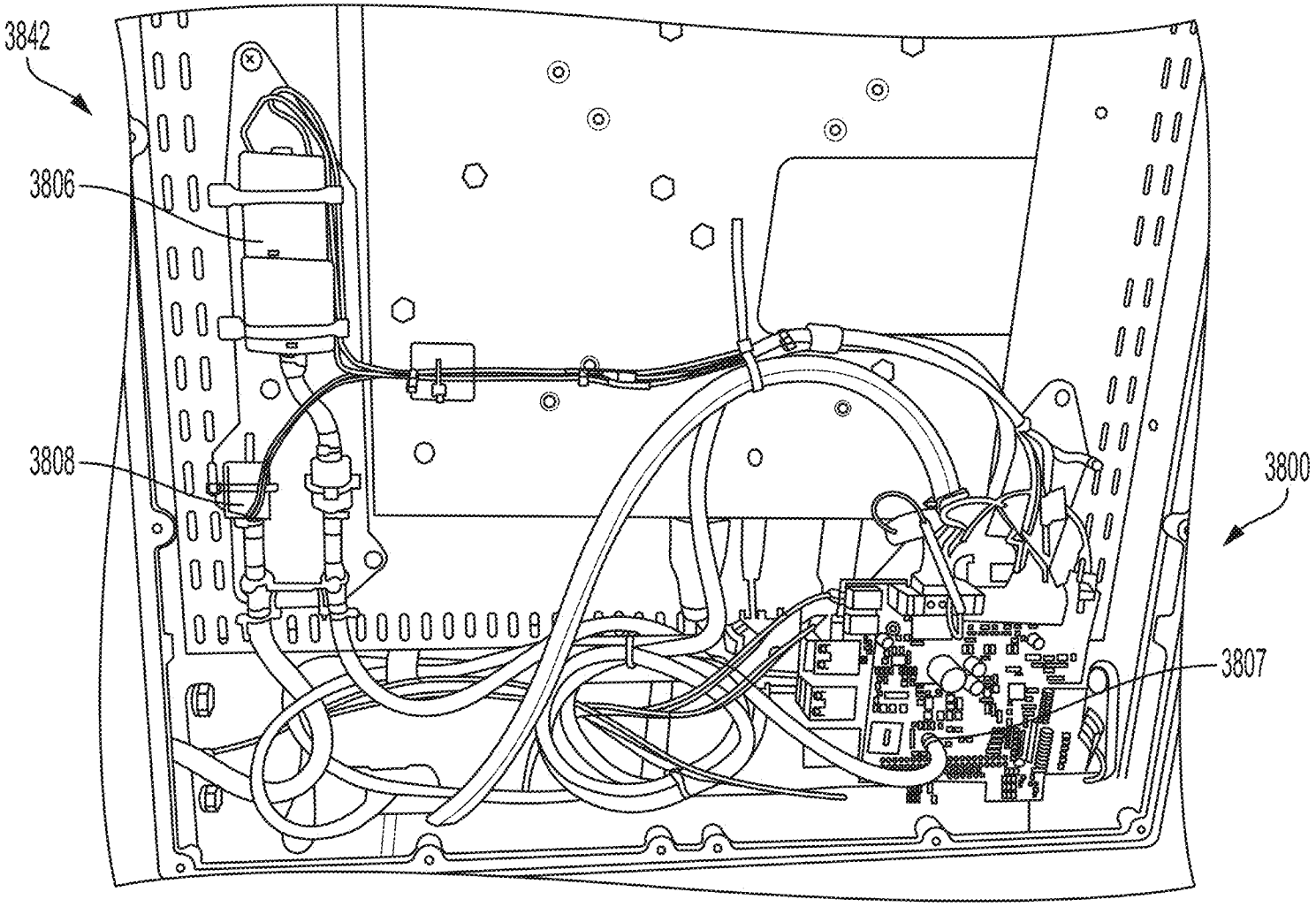
FIG. 14 shows control valves, flow devices and the like for the BFR System of FIGS. 12 and 13.

With reference to FIG. 14, in the case of a pneumatic system, the unweighting machine 3840 can include a pneumatic pump 3806, a pressure sensor 3807, and an air release valve 3808. The exercise machine may further include a microphone or blood pressure sensor 3809 and monitoring system (not shown), and other sensory electronics used for calculating a limb occlusion compression that can be used in some cases for determining the corresponding pneumatic pressure setting for performing blood flow restriction training at a certain occlusion percentage of the full occlusion pressure measured or determined for that limb. Determining limb occlusion pressure (LOP) is well understood and can be determined for a given limb and BFR controllable band or strap via blood pressure monitor devices, which can include blood pressuring monitoring controllers and sensors such as doppler sensing devices operating based on well-known sphygmomanometer techniques.

In some arrangements, a pressure controlled band can be pressurized to exert compression on a limb beyond what is typically required for fully occluding arterial blood flow to the limb. The device can slowly release pressure in the band, and thereby compression exerted on the limb, while sensing or 'listening' via doppler methods for the band pressure value at which arterial blood flow resumes, which can be established as the limb occlusion pressure (LOP) for the particular limb and band. BFR techniques can include controlling pressure for the band and limb within a range of 20 percent to 80 percent of the established LOP. The pump 3806 can reside in a console of the exercise machine 3840, which for example purposes can include the aspects and preferences of DAP System 3240 along with a computer system 3800 that can include the aspects and preferences of computer system 3300 discussed above except as noted hereafter. Alternatively the pump and other electronics can reside elsewhere on the exercise machine as long as the hosing is sufficient to reach the user for inflating the bands and determining LOP and band pressure. Accordingly, like nos. can refer to like features.

With continued reference to FIG. 14 along with FIGS. 12 and 13, pneumatic pump 3806 and control computer system 3800 pertaining to blood flow controls can have one or more tubes that can apply pressurized air from the compressor or pump 3806 to the blood flow bands 3804 that can be attached to the user. The hose or hoses can be retractable or the exercise machine can include one or more holders that can secure a connector that can attach to the blood flow bands such that the connectors are readily available by the user to connect to the blood flow straps. The compressor and pump 3806 can be controlled by a controller 3800 incorporated as part of DAP System computer system 3800 and/or provided as a supplemental control or modules, which can monitor pressure and operate one or more release valves and the pneumatic pump and air compressor 3806 based on a pressure control algorithm for controlling a desired blood flow pressure. This monitoring and BFR training can occur during initial setup, periodically during exercise when the user is asked to remain stationary and/or ambulate slowly, or continuously.

In some cases, the blood flow bands 3804 can be inflated prior to operation of the unweighting machine 3840, as it can be beneficial for a user to be stationary during the inflation of the bands 3806 for maintaining stable blood pressure until a blood flow pressure value is reached. A blood flow pressure value can be determined during exercise via DAP System 3840 via a determined limb occlusion pressure, which can be determined by the microphone, BP sensor and/or monitor devices 3809, such as by listening for Kirchhoff sounds corresponding with sounds typically generated via sphygmomanometer for measuring blood pressure. A blood flow pressure can be determined by calculating a percentage of the measured blood pressure value that can be generally around 80% for lower body and around 50% for upper body for easy exercise but may be as low as 40% of limb occlusion pressure for more intense exercise. Alternatively, a blood flow pressure value can be determined based on limb circumference that can be stored in memory for future sessions as a benchmark to either increase or decrease the blood flow pressure value. Alternatively, a blood flow pressure may be determined based on band size, user history, a heart rate variability (HRV) response, or other physiologic characteristics.

After inflation of the bands to a blood flow pressure, the DAP system can operate the treadmill and blower to unweight the user and cause them to perform controlled exercise. As measured blood pressure increases, the blood flow pressure value in the bands can be caused to increase or decrease due to the additional external pressure on the bands, and therefore the initial setting can be related and/or adjusted to the amount of unweighting that is going to be performed. Additionally as the unweighting increases the amount of work decreases. As such, the DAP system can control one or more bands to increase the amount of blood flow pressure in order to maintain sufficient workload of the user. This adjusted pressure algorithm can be preset at the beginning of the session or can be manually actuated and adjusted during the session. An adjustment mid-session can require a user to stop first, let the measured blood pressure and percent of limb occlusion pressure adjust to maintain the initial setting while they are not moving and/or be recalibrated, and then resume exercise to take into account changes in limb dynamics from exercising. Alternatively, the DAP system can estimate a pressure adjustment required, and apply such adjustment by opening a release valve for a specific time period that has been pre-correlated to an amount of pressure loss, or in the case of increased pressure required, activate the pneumatic pump for a period of time correlated with a known pressure increase, or re-calculate LOP and percentage controls. The DAP system and blood flow controller can also constantly monitor and maintain the blood flow pressure applied to the bands by activating the valve and pump alternately to maintain a more constant pressure, which can be feasible during slower walking and with large enough pumps and valves with a short mechanical time constant.

Alternatively a user can also increase and adjust blood flow pressure with an interface that applies or removes pressure for a pre-determined amount of time that has been pre-correlated roughly to an amount of pressure increase or decrease. In this way, a user can constantly adjust the blood flow pressure level value or values without stopping exercise which can add convenience and ease of use. In some cases, blood flow devices can be provided that do not fully occlude blood flow, and thus safety can be maintained with continuous adjustment of blood flow levels without stopping and re-calculating blood flow pressure or worrying about pressure accuracy.

Figure 15:
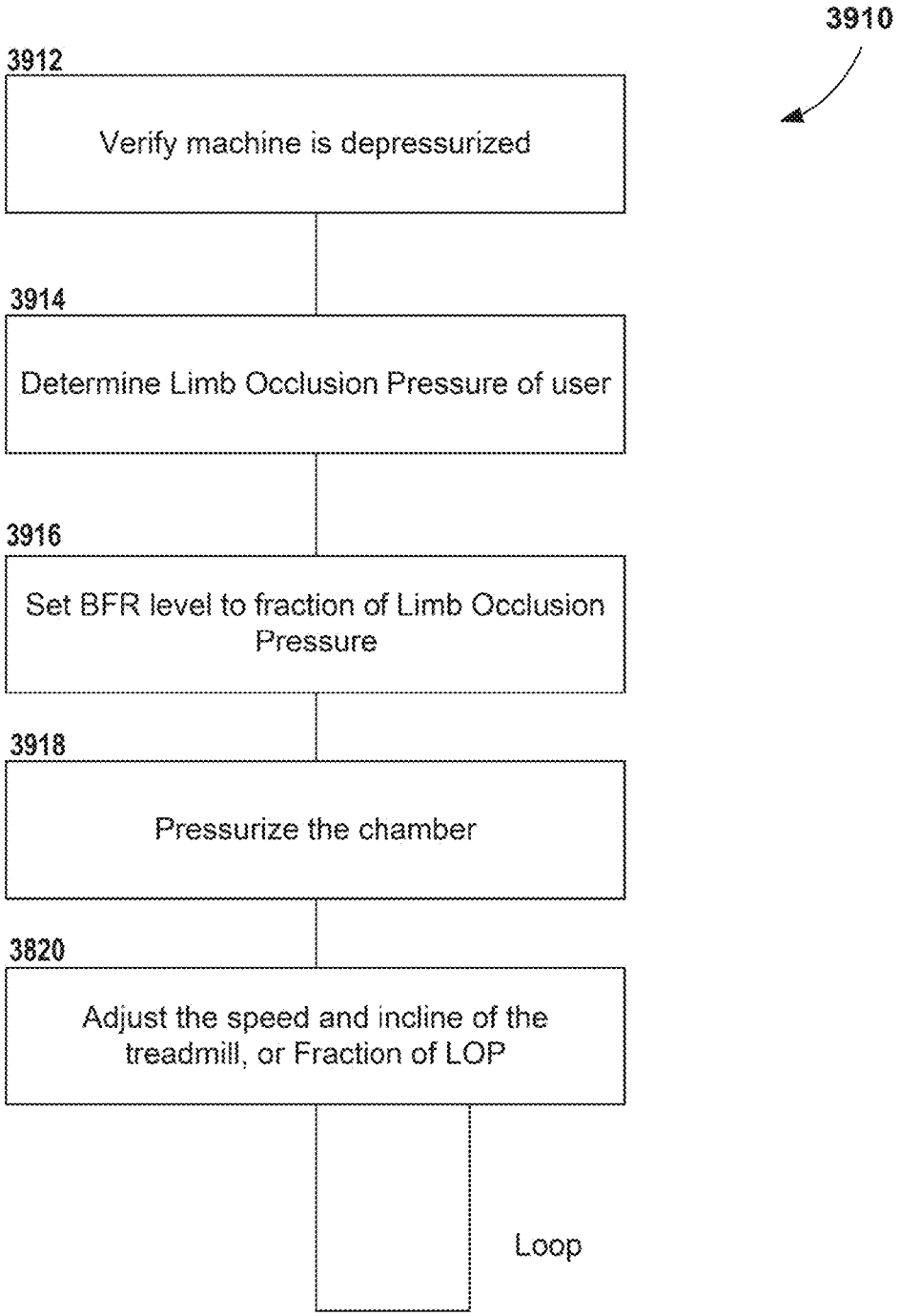
FIGS. 15 to 18 schematically depict methods and routines related to the example BFR System of FIGS. 12 to 14.

Referring now to FIG. 15, a general blood flow training method 3910 is shown for use with a DAP System, such as DAP System 3240 or 3840. The Method 3910 can include an action 3912 of verifying the DAP System is depressurized, and an action 3914 of determining limb occlusion pressure of a user. Actions can be performed together for a user in a rest or low activity level, and can be considered a single action of determining user LOP. LOP can preferably be determined independent of enclosure pressurization effects on the user. However, Action 3914 can optionally be performed while the enclosure is in the pressurized condition, which can be beneficial for comparison with a LOP determination while in the uninflated condition and for evaluating enclosure pressure effects on the user. Further, Action 3914 and/or Action 3912 combined with Action 3914, can be repeated periodically as desired for recalibration purposes and other purposes, such as evaluating BFR training and session effects on the user. The Method can further include an action 3916 for setting a blood flow level to a fraction of the determined or redetermined limb occlusion pressure. Method 3910 can further include the action 3918 of pressurizing the enclosure 3810 and the repeated action 3820 of adjusting the speed and/or incline of the treadmill, or fraction of limb occlusion pressure as desired for a BFR training session or routine.

Figure 16:
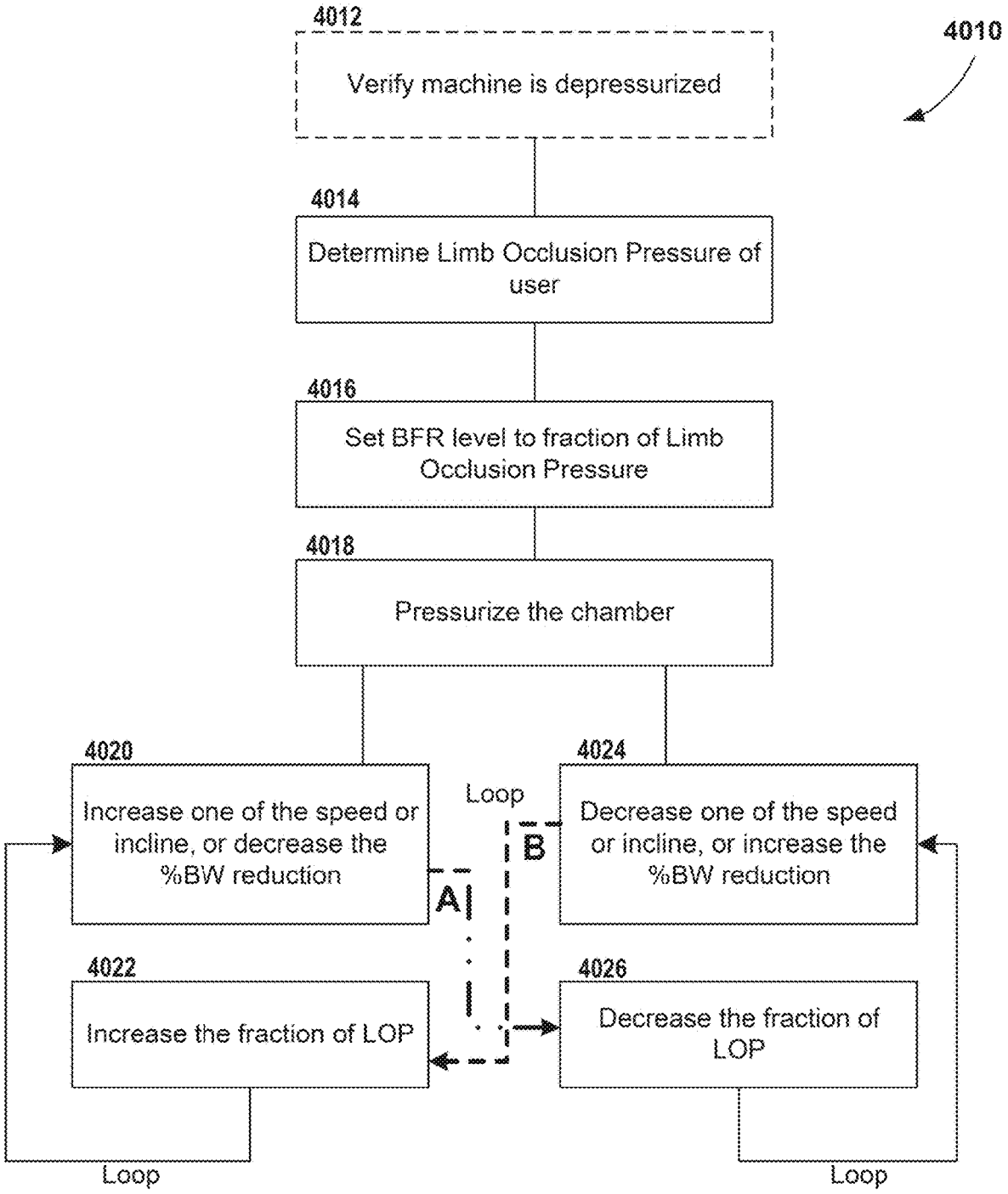

Referring now to FIG. 16, another blood flow training method 4010 for use with a DAP System, such as DAP System 3240 or 3840 can include an action 4012 of verifying the DAP System is depressurized, followed by an action 4014 of determining limb occlusion pressure of a user, and an action 4016 for setting a blood flow level to fraction of limb occlusion pressure. As discussed above for Method 3910, each of these Actions can be performed in combination as single overall Action, independently such as for recalculation or redetermination, and/or for comparison, evaluation and training purposes such as performing Actions 4014 and 4016 while in the pressurized state. Further, although Actions 4012, 4014 and 4016 are shown as initial actions of Method 4010, no order is required or implied for Method 4010 as well as Method 3910, except as described herein such as Loops A & B described below. For example, Action 4012 can occur midway through a training session for performing a rest condition as part of BFR training for the user, Actions 4014 and 4016 can occur in the pressurized condition under low ambulation in accordance with desired therapeutic plans or BFR training, and action 4018 can be performed along with no or low BFR pressure applied in combination with high enclosure pressurization. In addition, Method 4010 can further include an Action 4018 of pressurizing the enclosure 3810, such as for typical DAP system usage, followed by alternative options and related continuing loop actions.

Method 4010 can include cooperative training actions that can take advantage of unweighting tools, BFR tools and exercise intensity tools in synergistic combinations that can enhance session and training benefits for users. In one arrangement cooperative actions involving such tools can include alternative and/or alternative actions including, as an example, a cooperative combination of actions (A) including Action 4020 for increasing one of the speed or the incline of the treadmill exercise device, or decreasing the weight reduction (by increasing the air pressure), which can be followed by the Action 4026 of decreasing the fraction of limb occlusion pressure (LOP) for one or more controllable bands attached to the user, or in the case of a non-occlusive band where LOP is not used, simply reducing the compression by loosening straps or reducing band blood flow pressure.

In some arrangements, cooperative combinations for Method 4010 involving various treatment tools can include combination of actions (B) including Action 4024 for decreasing one of the speed or the incline of the treadmill exercise device, or increasing the body weight reduction via increasing the pressure in the enclosure followed by the Action 4022 of increasing the fraction of LOP, or in the case of a non-occlusive band where LOP is not used, simply reducing the compression by loosening straps or reducing band blood flow pressure. In some arrangements for Method 4010, Combinations A can be performed including Actions 4020 and 4026. In other arrangements for Method 4010, Combinations B can be performed including Actions 4024 and 4022. In further arrangements for Method 4010, either Combinations A or B can be included as selected by the user. In further arrangements for Method 4010, the user can select as alternative options either combinations or path (A) including actions 4020 and 4026, or combinations or path (B) including actions 4024 and 4022, and the method 4010 can further include continuing in an alternating loop manner between option path (A) and option path (B).

As depicted in FIG. 16 for example arrangements of Actions of involving combinations of training or rehabilitation tools including unweighting tools, exercise device and intensity tools, and BFR tools, such tools can synergistically work together and be combined so as to make the exercise harder for a user that can maintain a given intensity, or rather enable a greater overall intensity than otherwise available for the user. This can include reduced loading (lower speed, lower incline, lower body weight via increased pressure) as appropriate for capabilities of the user in which case the user can generally increase the blood flow pressure (applied LOP % and level of partial occlusion) to make the work harder to compensate for the reduced loading or exercise level, which overall increasing overall intensity and training effects on the user. The reverse also applies in that during training periods that include cycles for removing or significantly reducing applied partial occlusions, and/or during training periods at which the user is able to exercise at comparatively high intensity (e.g., higher speed, greater incline, greater body weight via decreased enclosure pressure), BFR training effects (e.g., applied LOP % and level of partial occlusion) can correspondingly be discontinued or significantly reduced. Thus, overall exercise intensity and combined training benefits can be increased compared with training the excludes BFR or any of the combined tools. Of course, the particular combinations of tools and cycles can be modified further including in accordance with user inputs or manual adjustments, such as manually adjusting the blood flow pressure at any point should the workout be too easy as a way to compensate for the lack of workload intensity without increasing the exercise device options, such as running faster, uphill, or at heavier weight, and vice versa.

Figure 17:
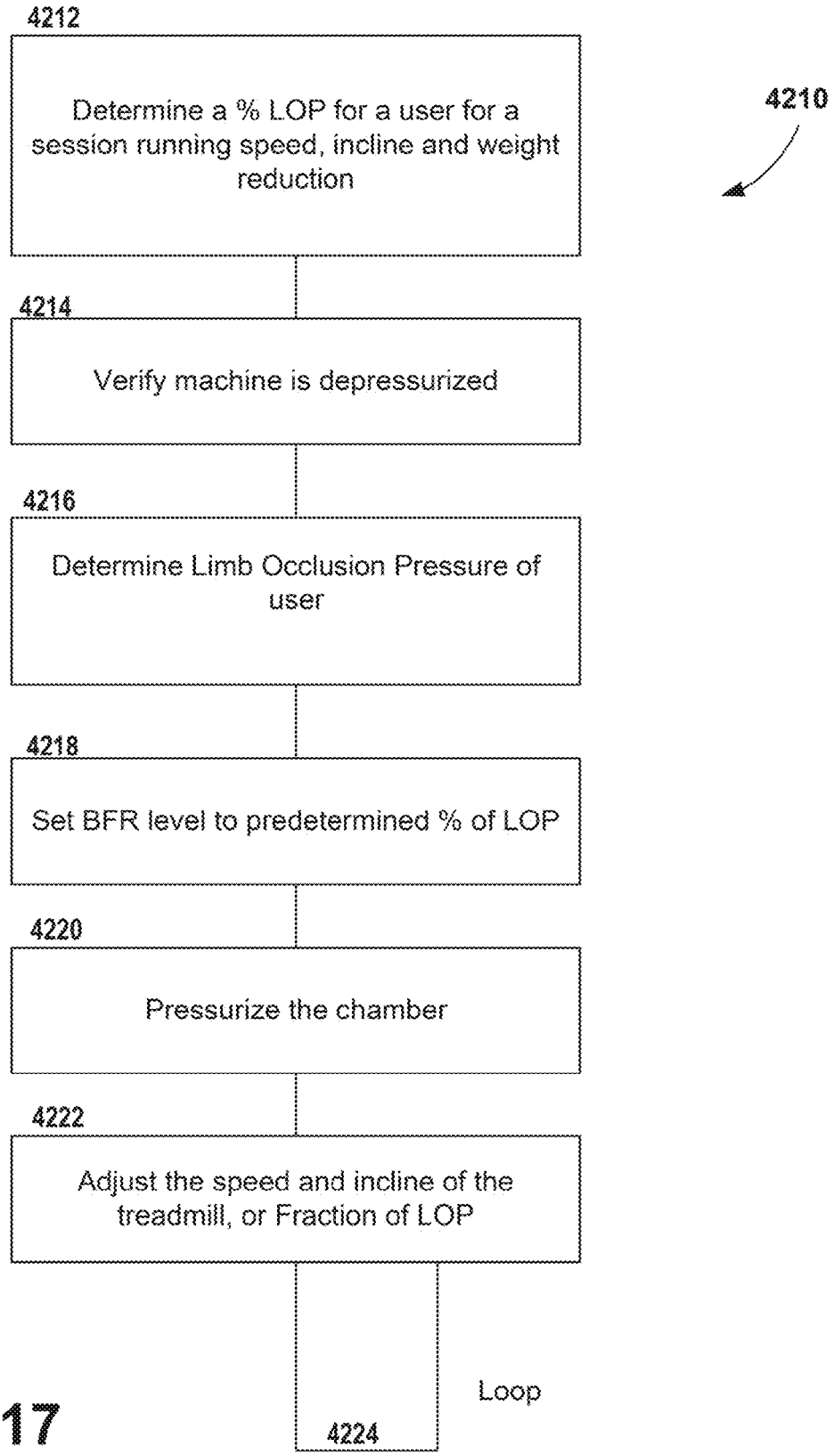

Referring now to FIG. 17, a general blood flow method 4210 is generally shown for use with a DAP System, such as DAP System 3240 or 3840, which can be a relatively simple, easy to adjust, and/or readily customizable or manually controllable method that can nonetheless enable cooperative, synergistic benefits for the user provided by a more defined, combination of tools method, such as Method 4010 as described above. Similar to Methods 3910 and 4010, Method 4210 can include baseline actions pertaining to BFR including an Action 4212 of predetermining a percentage limb occlusion pressure for a user for a session of use of a DAP System 3840 for treadmill exercises including factors, for example, of running speed, treadmill incline, and unweighting (weight reduction). The method 4210 can further include the Action 4214 of verifying the DAP System is depressurized, followed by an Action 4216 of determining limb occlusion pressure of the user [Why if using predetermined LOP?]. Method 4210 can further include an Action 4218 for setting a blood flow level to the predetermined percentage of limb occlusion pressure. In addition, Method 4210 can include the Action 4220 of pressurizing the enclosure 3810 and the repeated action 4222 of adjusting the speed and incline of the treadmill or fraction of limb occlusion pressure.

As a recovery option, it can be useful after an exercise session to cycle the BFR pressures for promoting blood flow into the deep venous system and releasing pressures to flush out the deep venous system. The DAP system and BFR controls can thereafter be synchronized opposite to this cycle, such that when the bands are pressurized for applying high compression and occlusion that traps blood in the lower extremity, the pressure in the flexible enclosure can be reduced so as to minimize effects of the pressure differential across the user contrary to the purpose and intent of higher BFR pressure, compression and occlusion. Likewise, when the BFR pressure is released along with partial occlusion, the pressure in the chamber can simultaneously be increased for augmenting the return of the blood out of the deep venous system. As such, increased enclosure pressure can synergistically cooperate with BFR actions for releasing BFR pressure, applied compression and blood flow occlusion. The user can be stationary during this period or can ambulate slowly.

Figure 18:
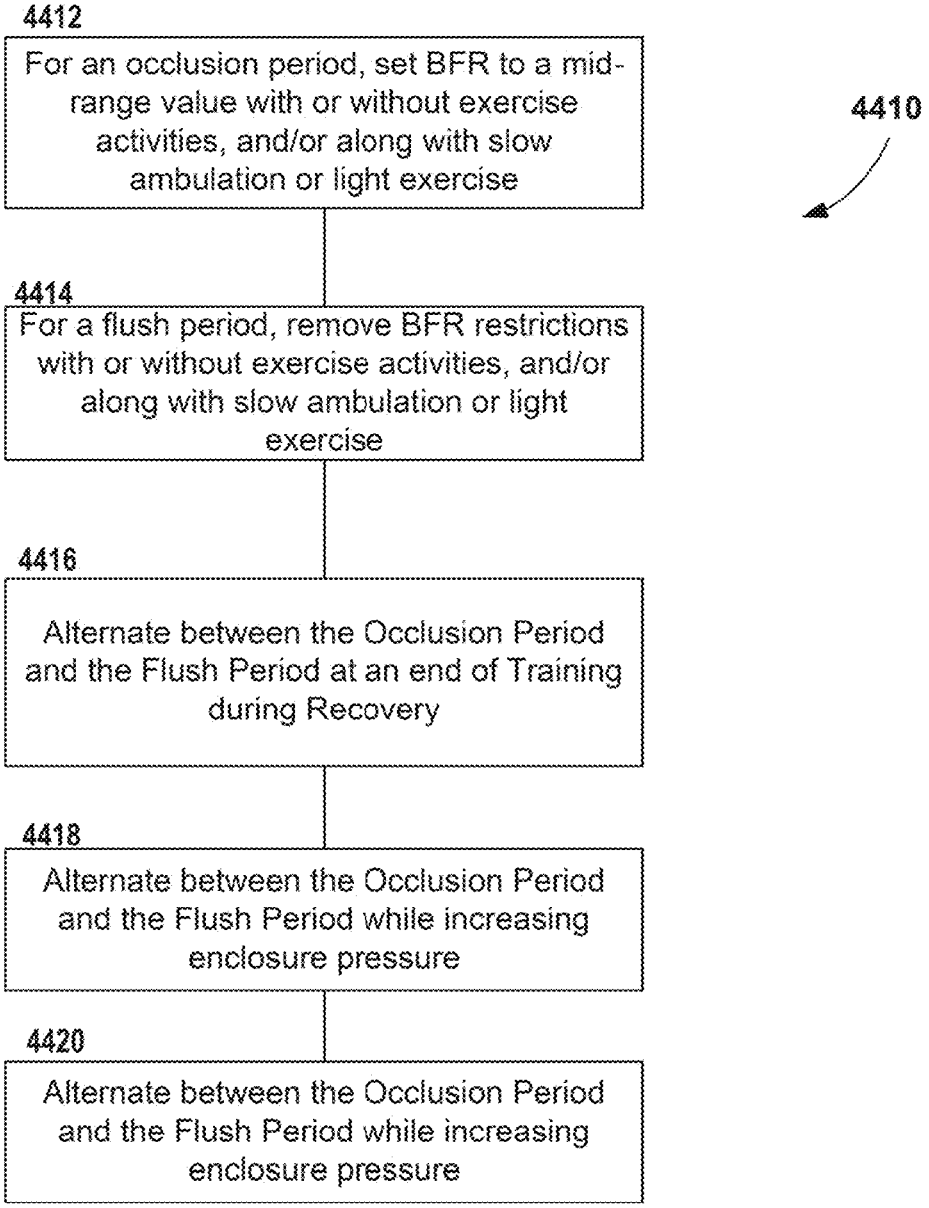

Referring now to FIG. 18, a Method 4410 is generally depicted for performing training recovery using BFR with a DAP system, such as DAP System 3240 or 3840. Method 4410 can include an Action 4412 of applying pressure to the bands for partially occluding blood flow at a percentage of LOP, such as at mid-range value of about 40% LOP for legs and about 25% for arms, for an occlusion period, such as for two or three minutes. Method 4410 can further include an Action 4414 of withdrawing occlusion restrictions for a flush period, such as for two or three minutes. Action 4412 for the occlusion period and Action 4414 for the flush period can be performed independent of exercise activity, and further can be performed as part of cool down or post-training recovery. For example, Action 4412 can be performed without the user performing exercise activity, during slow ambulation, and/or concurrent with light exercise activities. Method 4410 can further include Action 4416 of alternating between the occlusion period and the flush period at an end of training during recovery, which can include reducing periods for each. Action 4416 can promote flow into the deep venous system for the user during the occlusion period, and subsequent flushing of the deep venous system during the flush period. The Method 4410 can include Action 4418 of performing or continuing Action 4416 concurrent with increasing enclosure pressure. Further, Method 4410 can include Action 4420 of performing or continuing Action 4418 combined with synchronized enclosure pressure increases and decreases corresponding in reverse with the occlusion period and the flush period, such that increased enclosure pressure is applied during the flush period and reduced pressure is applied during the occlusion period. Action 4420 can encourage enhanced fluid shift out of the deep venous system, which can occur proximate an end of recovery for the user.

It is understood that while generally concepts for blood flow bands above have been described as pneumatic, cinchable straps can be used instead and motors that control tension in such straps or cabling connected to such straps controlled by motors in the DAP system equivalent to the pneumatic pump described can be used. Accordingly, concept and features described herein pertaining to modifying blood flow pressure along with exercise or training sessions with a DAP system can carry across multiple such methods and actions for applying compression and occluding blood flow, and all such methods shall be considered within the scope of this application.

Further, it is understood that for methods of unweighted blood flow training, a user can detach the hoses from the bands after initial setup and perform exercise, and can reattach the hose mid workout to check settings, adjust settings, and/or perform actions involving BFR training, and therefore the hoses need not be constantly attached to the bands as shown in FIGS. 12 and 13. In the case of permanent attachment, the garment can include ports or hose extensions that make it convenient to attach the hose for applying pressure to the garment after the user is already attached to the user seal, in this way, as shown in FIG. 13, the user need not disconnect from the user seal in order to connect or disconnect the blood flow hoses or to set up or modify pressure, and can be constantly monitored by the blood flow controller in the DAP machine.

The subject matter described above is provided by way of illustration only and should not be construed as limiting. Various modifications and changes may be made to the subject matter described herein without following the example arrangements, embodiments and applications illustrated and described, and without departing from the true spirit and scope of the embodiments, arrangements, or of the concepts and technologies disclosed herein.

Although various arrangements and embodiments have been described as having particular features and/or combinations of components, other embodiments and arrangements are possible having a combination of any features and/or components from any of embodiments or arrangements as discussed above. Aspects have been described in the general context of exercise devices, and more specifically supplemental lifting, unweighting or differential air pressures mechanisms, devices, systems, and methods for exercise devices, but inventive aspects are not necessarily limited to use with exercise devices.

We claim:

1. A method for controlling a differential air pressure (DAP) system during use by a user, the DAP system comprising:

an inflatable enclosure having a base extending upward when inflated from the base to a top opening defined therein and configured for attachment with a user seal interface;

a platform retaining an exercise device within a cavity defined therein and securing the enclosure base above the exercise device for enabling user access to the exercise device;

a pair of powered vertical lifts secured to opposite lateral sides of the platform at a mid-region proximate the top opening, each having a vertically drivable carriage;

a seal frame connected to each carriage at opposite ends, the seal frame extending about the top opening and attached to the enclosure at an offset distance from the top opening; and a control system computer operatively connected to the exercise device, an inflation source coupled to the DAP system in an airtight connection, and the pair of powered lifts;

wherein a user seal worn by a user comprises an interface configured for secure, airtight attachment with the top opening during use of the DAP system for unweighting the user and enabling user access to the exercise device;

the method comprising:

calculating a user seal interface height based on an estimated height for the user;

determining, based on the user seal interface height, an attachment carriage height and a usage carriage height different than the user seal interface height;

driving the powered vertical lifts to raise each carriage to an attachment position at the attachment carriage height while the user is positioned in the DAP system through the top opening, the driving comprising raising about the user the seal frame attached to the carriages and thereby raising the top opening attached to the seal frame at the offset distance;

controlling the powered vertical lifts to retain the attachment position during user seal attachment to the top opening;

confirming attachment of the user seal interface to the top opening;

responsive to the confirming attachment, driving the powered vertical lifts to move each carriage to a usage position at the usage carriage height; and inflating the enclosure comprising operating the pressure source to inflate the enclosure to an unweighting pressure and controlling the lifts to retain the usage position.

2. The method of claim 1, wherein the attachment carriage height is one of the following: substantially the same as the usage carriage height or different from the usage carriage height.

3. The method of claim 1, wherein the determining the attachment carriage height and the usage carriage height further comprises:

determining an offset height between a middle portion of the seal frame and connections of the seal frame to each of the carriages, the seal frame middle portion extending about the top opening and attached to the enclosure at the offset distance from the top opening;

determining the offset distance between the seal frame attachments to the enclosure and the top opening;

calculating the attachment carriage height based on the user seal interface height, the offset height, and the offset distance; and calculating the usage carriage height based on the user seal interface height, the offset height, and the offset distance.

4. The method of claim 1, wherein the calculating the user seal interface height comprises:

receiving an input of an estimated height for the user; and computing the user seal height as forty-five percent (45%) to sixty (60%) of the estimated height for the user.

5. The method of claim 4, wherein the computing the user seal height further comprises computing the user seal height as about fifty-five percent (55%) of the estimated height for the user.

6. The method of claim 4, wherein the calculating the user seal interface height further comprises:

receiving at least one estimated anthropomorphic category for the user comprising: an estimated leg height percentile and an estimated age; and computing the user seal interface height as greater than, less than, or about fifty-five percent according to the at least one estimated anthropomorphic category.

7. A method for adjusting user-interface height during usage of a differential air pressure (DAP) system by a user, the DAP system comprising:

a platform having a cover defining an access opening into an internal cavity defined within the platform;

a treadmill retained by the platform within in the internal cavity, the treadmill substantially exposing a top treadmill surface through the access opening;

an inflatable enclosure having a base defining a base opening secured to the cover about the access opening and extending upward to a top opening defined therethrough;

a pair of powered vertical lifts connected to opposite sides of the platform along a longitudinal mid-region proximate the top opening, each having a vertically drivable carriage;

a seal frame having a pair of opposite restraint connectors;

a pair of flexible tensile restraints, each attached at one end to a corresponding restraint connector and at an opposite end to a corresponding carriage; and a user seal worn by a user having a user seal interface configured for attaching to the inflatable enclosure at the top opening when the user extends through the top opening and engages the top treadmill surface for using the DAP system in an unweighting condition;

the method comprising:

determining a user seal interface height for the user;

determining a usage carriage height based on the user seal interface height for the user, the user seal interface height different from the usage carriage height;

raising each carriage to a user seal attachment position higher than the usage carriage height for attachment of the user seal interface to the enclosure;

lowering each carriage to the usage carriage height;

confirming inflation conditions are met including attachment of the user seal interface to the inflatable enclosure at the top opening;

inflating the enclosure to an inflated condition; and restraining the user seal interface at the user seal interface height including restraining the seal frame at a seal frame height according to the usage carriage height.

8. The method of claim 7, wherein:

determining the user seal interface height comprises one of:

(i) calculating the user seal interface height for the user based on a user input of a height feature of the user, the height feature comprising one of a user height estimate and a height feature for the user different from the user height, wherein for the height feature different from the user height the calculating further comprises estimating a user height according to the height feature;

(ii) setting the user seal interface height for the user to a previous user seal interface height for a previous DAP system used by the user; and (iii) determining the user seal interface height for the user based on one of action (i) and action (ii) and further based on a modification factor input for the user.

9. The method of claim 8, action (i) further comprising:

calculating the user seal interface height as forty-five percent to sixty percent of one of the user height estimate input by the user and the estimated user height.

10. The method of claim 9, wherein the calculating comprises calculating the user seal interface height as about fifty-five percent of the user height estimate input by the user or the estimated user height.

11. The method of claim 7, wherein the pair of restraints define a restraint height in the inflated condition, the restraint height comprising a vertical distance between each flexible tensile restraint attachment to a corresponding restraint connector and attachment to the corresponding carriage, the determining the usage carriage height further comprising:

subtracting from the user seal interface height the restraint height.

12. The method of claim 11, wherein:

in the inflated condition, the seal frame defines a user seal interface boundary region between the seal frame and the user seal interface, the boundary region extending upward from the seal frame in the inflated condition and defining a vertical drop distance from the user seal interface to regions of the seal frame disposed about the user seal interface; and a middle region of the seal frame is disposed about the seal frame interface, and the middle region is vertically offset from the pair of opposite restraint connectors;

the determining the usage carriage height further comprising:

subtracting the vertical drop distance from the user seal interface height; and subtracting the middle region offset height from the user seal interface height.

13. The method of claim 7, further comprising:

detecting a critical error; and stopping at least one of treadmill operations, lift operations, and enclosure inflation operations.

14. The method of claim 13, the detecting the critical error further comprises:

repeatedly detecting an enclosure pressure when the enclosure is in the inflated condition; and determining if each detected enclosure pressure exceeds a predetermined threshold;

wherein, upon determination that the detected enclosure pressure exceeds the predetermined threshold, the stopping comprises:

stopping treadmill operations;

interrupting any lift operations; and deflating the enclosure.

15. The method of claim 13, the method further comprising:

adjusting the user seal interface height comprises a drive motor of each lift driving vertical movement of each lift from the usage carriage height to a modified usage carriage height; and while performing the adjusting, repeatedly doing at least one of the following:

repeatedly detecting the enclosure pressure;

determining if each detected enclosure pressure exceeds a predetermined threshold;

monitoring a vertical carriage position for each carriage;

continually determining a vertical offset between each vertical carriage position;

determining if each determined vertical offset exceeds a predetermined threshold offset;

monitoring a current draw for each drive motor; and continually determining if the current draw for each motor exceeds a predetermined threshold current draw;

wherein, upon determination that at least one of the detected enclosure pressure, the deter mined vertical offset and the current draw for each drive motor exceeds the corresponding predetermined threshold, the stopping comprises at least one of the following:

stopping treadmill operations;

interrupting each of the drive motor operations; and deflating the enclosure.

16. The method of claim 13, wherein:

the DAP System further comprises at least one user-removable coupling connector connecting each seal frame restraint connector to the corresponding carriage;

the detecting the critical error comprises detecting disconnection of the at least one user-removable coupling connector; and the stopping comprises stopping any treadmill operations, lift operations, and enclosure inflation operations.

17. The method of claim 7, further comprising:

calculating output and cumulative load for the user during usage of the DAP system; and providing calculated output and cumulative load information to the user for at least one user session on the DAP system; historical calculated and cumulative load information for the user; and updated historical calculated and cumulative load information comprising the historical calculated and cumulative load information updated for the user session.

18. The method of claim 17, wherein the calculating output and cumulative load for the user comprises calculating output according to a relationship comprising:

$$(1-((-0.1302*\%\ BW)+1.2045))*(3.5+(0.2*v)+(0.9*v*G))/3.5,\ \text{wherein:}$$

% BW=body weight % (in decimal form);

v=velocity in meters/min; and

G=% gradient (in decimal form).

19. A Method for controlling a differential air pressure (DAP) system during use by a user for a current unweighted exercise session, the DAP system comprising:

an inflatable enclosure having a base extending upward when inflated from the base to a top opening defined therein and configured for attachment with a user seal interface;

a platform for retaining an exercise device and securing the enclosure base above the exercise device;

a pair of powered vertical lifts secured to the platform, each having a vertically drivable carriage;

a seal frame connected to each carriage extending about the top opening and attached to the enclosure proximate the top opening; and a control system computer operatively connected to the exercise device, an inflation source coupled to the DAP system in an airtight connection, and the pair of powered lifts;

wherein a user seal worn by a user comprises an interface configured for secure, airtight attachment with the top opening during use of the DAP system for unweighted exercise;

the method comprising:

calculating a user seal interface height based on an estimated height for the user;

determining, based on the user seal interface height, an attachment carriage height and a usage carriage height different than the user seal interface height;

driving the powered vertical lifts to raise each carriage to an attachment position at the attachment carriage height;

confirming attachment of the user seal interface to the top opening;

responsive to the confirming attachment, driving the vertical lifts to move each carriaae to a usage position at the usage carriage height;

inflating the enclosure comprising operating the pressure source to inflate the enclosure to an unweighting pressure and controlling the lifts to retain the usage position;

calculating an output for the user for the current unweighted exercise session and for an equivalent non-unweighted exercise session based on exercise parameters for each session, the exercise parameters comprising a speed, a %grade, and a %bodyweight for each session, wherein:

the %bodyweight for the non-unweighted exercise session is a bodyweight of the user; and the %bodyweight for the current unweighted exercise session is the bodyweight of the user multiplied by a reduced value corresponding with an unweight support percentage applied by the inflated enclosure to the user, the %bodyweight having a value less than 1.00; and providing output information to the user for the current unweighted exercise session and the non-unweighted exercise session.

20. The method of claim 19, wherein the calculating output for the user comprises calculating output for the current unweighted exercise session according to a relationship comprising $$(1-((-0.1302*\%BW)+1.2045))*(3.5+(0.2*v)+(0.9*v*G))\ /\ 3.5.$$

* * * * *